US008641034B2

(12) United States Patent
Kapturowski et al.

(10) Patent No.: US 8,641,034 B2
(45) Date of Patent: Feb. 4, 2014

(54) ROTARY AND GRIPPER SYSTEM INCLUDING BACK SUPPORT STACK ASSIST ASSEMBLY HAVING A TAMPER BAR AND HOLDBACK VACUUM

(71) Applicant: Bell and Howell, LLC., Wheeling, IL (US)

(72) Inventors: Edward J. Kapturowski, Apex, NC (US); Robin L. Heilman, Garner, NC (US); Aaron A. Kracht, Raleigh, NC (US); Todd Murdock, Clayton, NC (US)

(73) Assignee: Bell and Howell, LLC., Durham, NC (US)

( * ) Notice: Subject to any disclaimer, the term of this patent is extended or adjusted under 35 U.S.C. 154(b) by 0 days.

(21) Appl. No.: 13/778,015

(22) Filed: Feb. 26, 2013

(65) Prior Publication Data

US 2013/0168917 A1 Jul. 4, 2013

Related U.S. Application Data

(62) Division of application No. 13/354,150, filed on Jan. 19, 2012.

(60) Provisional application No. 61/510,529, filed on Jul. 22, 2011.

(51) Int. Cl.
*B65H 3/62* (2006.01)

(52) U.S. Cl.
USPC ..... 271/104; 271/137

(58) Field of Classification Search
USPC ..... 271/99–101, 104, 3.07, 3.02, 3.05, 123, 271/133, 137, 146
See application file for complete search history.

(56) References Cited

U.S. PATENT DOCUMENTS

| | | | | | |
|---|---|---|---|---|---|
| 3,544,097 | A | | 12/1970 | Linden | |
| 3,945,095 | A | * | 3/1976 | Herold et al. | 271/210 |
| 3,984,096 | A | * | 10/1976 | Barkley | 271/129 |
| 4,147,342 | A | * | 4/1979 | Naramore | 271/221 |
| 4,318,541 | A | * | 3/1982 | Nagel et al. | 271/222 |
| 4,657,239 | A | * | 4/1987 | Ikesue et al. | 271/227 |
| 4,701,094 | A | | 10/1987 | Courjaret et al. | |
| 4,832,327 | A | | 5/1989 | Johansson | |

(Continued)

FOREIGN PATENT DOCUMENTS

| | | | |
|---|---|---|---|
| DE | 102 14 381 | A1 | 10/2003 |
| GB | 08167 | A | 0/1913 |

OTHER PUBLICATIONS

United States Office Action issued in U.S. Appl. No. 13/354,150 dated Apr. 2, 2013.

(Continued)

*Primary Examiner* — Jeremy R Severson
(74) *Attorney, Agent, or Firm* — McDermott Will & Emery LLP

(57) ABSTRACT

The present application relates to techniques and equipment to manufacture mailpieces containing inserts. The equipment can be an inserter or an envelope wrapper that collects documents and inserts on a collating track before the material is inserted into an envelope by inserting equipment or wrapped with paper or film to make an envelope by wrapping equipment. More specifically, the present application relates to a rotary insert feeder that feeds inserts to a collating track on inserting or wrapping type equipment.

13 Claims, 26 Drawing Sheets

(56) References Cited

U.S. PATENT DOCUMENTS

| | | | | | |
|---|---|---|---|---|---|
| 4,844,438 | A | * | 7/1989 | Mistyurik et al. | 271/181 |
| 4,844,440 | A | * | 7/1989 | Gray | 271/226 |
| 5,029,832 | A | | 7/1991 | Orsinger et al. | |
| 5,042,232 | A | | 8/1991 | Orsinger et al. | |
| 5,141,216 | A | | 8/1992 | Ballestrazzi et al. | |
| 5,174,559 | A | | 12/1992 | Diamantides | |
| 5,188,353 | A | * | 2/1993 | Parks | 271/184 |
| 5,302,079 | A | * | 4/1994 | Cestonaro et al. | 414/788 |
| 5,316,281 | A | | 5/1994 | Bale et al. | |
| 5,374,051 | A | * | 12/1994 | Ulrich et al. | 271/222 |
| 5,979,889 | A | | 11/1999 | Klopfenstein | |
| 6,042,102 | A | | 3/2000 | Raschke et al. | |
| 6,082,724 | A | | 7/2000 | Kahlig et al. | |
| 6,224,050 | B1 | | 5/2001 | Wicki | |
| 6,382,616 | B1 | * | 5/2002 | Waragai et al. | 270/58.12 |
| 6,619,650 | B2 | | 9/2003 | Gysin et al. | |
| 7,857,297 | B2 | | 12/2010 | Ong | |
| 7,909,750 | B2 | | 3/2011 | Howell et al. | |
| 8,056,898 | B2 | | 11/2011 | Folsom et al. | |
| 8,302,954 | B2 | | 11/2012 | Merkli | |
| 8,306,654 | B2 | * | 11/2012 | Marcinik et al. | 700/230 |
| 8,387,967 | B2 | * | 3/2013 | Bischoff et al. | 271/3.06 |
| 2002/0060391 | A1 | | 5/2002 | Muller | |
| 2006/0027960 | A1 | | 2/2006 | Richter et al. | |
| 2007/0069442 | A1 | | 3/2007 | Abegglen | |
| 2008/0018043 | A1 | | 1/2008 | Kaya et al. | |

OTHER PUBLICATIONS

Extended European Search Report issued in European Application No. 12161779.9 issued Aug. 21, 2013.

Extended European Search Report issued in European Patent Application No. EP 12161772.4 dated Sep. 27, 2013.

European Office Communcation issued in European Patent Application No. EP 12161772.4 dated Nov. 5, 2013.

United States Notice of Allowance issued in U.S. Appl. No. 13/844,177 dated Nov. 22, 2013.

United States Notice of Allowance issued in U.S. Appl. No. 13/354,150 dated Nov. 27, 2013.

* cited by examiner

ROTARY AND GRIPPER SYSTEM INCLUDING BACK SUPPORT STACK ASSIST ASSEMBLY HAVING A TAMPER BAR AND HOLDBACK VACUUM

CROSS-REFERENCE TO RELATED APPLICATIONS

This application is a Divisional Application of U.S. application Ser. No. 13/354,150, filed on Jan. 19, 2012, which claims the benefit of U.S. Provisional Application No. 61/510,529 entitled "Rotary Insert Feeder" filed on Jul. 22, 2011, the disclosures of which are entirely incorporated herein by reference.

TECHNICAL FIELD

The present subject matter relates to techniques and equipment to manufacture mailpieces containing inserts. The equipment can be an inserter or an envelope wrapper (mail processing system) that collects documents and inserts on a collating track before the material is inserted into an envelope by inserting equipment or wrapped with paper or film to make an envelope by wrapping equipment. More specifically, the present subject matter relates to a RIF that feeds inserts to a collating track on inserting or wrapping type equipment.

BACKGROUND

Currently available rotary feeders use a suction cup arrangement to pick the insert from the bottom of the feeder stack and pull the insert out from the bottom of the stack. Considerable force is needed to accomplish this task which results in rapid wear of the sucker cups. To mitigate the wear, only rigid sucker cups are used. For example a bellows sucker cup could not be used even though it would be superior for gripping non uniform inserts. A bellows sucker cup would wear fast and even tear due to the action associated with pulling the insert out of the bottom of the stack. The height of the stack is currently limited by the uniformity of the material which causes the leading edge of the stack to be non uniform. This will result in miss-feeds. The uniformity of the stack of inserts that are collected on the collating track is poor due to inaccurate placement of the insert relative to the collating track pusher pins due to a difference in velocity of the insert and the track or due to timing of the insert placement or due to air being trapped beneath the insert. Mechanical phasing of the feeders relative to the collating track and insert length also contribute to poor stack quality. Poor stack quality is a serious problem since it contributes to insertion jams, equipment stoppage and mailpiece damage.

Hence a need exists for a rotary feeder that is an improvement over existing technology which does not use a sucker cup to pull the insert out from the bottom stack, does not use a stack assist to justify the inserts to the front of the stack hopper; does not us electronic synchronization of the feeders to the collating track; and does not use a positive vacuum belt drive to place the insert on the collating track.

SUMMARY

It is desirable to provide a rotary insert feeder and related method, wherein the rotary insert feeder feeds stacked inserts to a collating track of document processing equipment. The rotary insert feeder includes a stacker for containing a vertical stack of the plurality of inserts. The stacker includes vertical side supports and a bottom plate. Two or more rotary drums are positioned below the bottom plate of the stacker. A separator hook is positioned above the rotary drums and the separator hook is configured to pivot from a first position interposed between the rotary drums and the bottom plate, to a second position away from the bottom plate and the rotary drums. Two or more gripper assemblies remove a bottommost insert from the vertical stack of inserts. The gripper assemblies are operably attached to a side surface of a respective one of the rotary drums, and each gripper assembly includes: a gripper finger and a spring loaded bottom seat. When the separator hook is in the first position, a leading edge of the bottommost insert is engaged between the gripper seat and the spring loaded bottom seat during a closing operation of each gripper assembly such that the bottommost insert is removed from the vertical stack. The gripper assemblies are driven synchronously, and each gripper assembly is configured to operate with an independent gripping force based on at least a thickness of the bottommost insert.

It is further desirable to provide a rotary insert feeder and related method, wherein the rotary insert feeder feeds inserts to a collating track of document processing equipment. The rotary insert feeder includes a stacker for containing a vertical stack of the inserts. The stacker includes vertical side supports and a bottom plate. Two or more rotary drums are positioned below the bottom plate of the stacker. A separator hook is positioned above the rotary drums, and the separator hook is configured to pivot from a first position away from the bottom plate and the rotary drums, to a second position interposed between the rotary drums and the bottom plate. Two or more gripper assemblies remove a bottommost insert from the vertical stack of inserts. The gripper assemblies are operably attached to a side surface of a respective one of the rotary drums, and each gripper assembly includes a gripper finger and a spring loaded bottom seat. A vacuum mechanism is positioned between the rotary drums. The vacuum mechanism is configured to contact a leading edge of the bottommost insert and move the bottommost insert in a downward direction toward to the rotary drums when the separator hook is in the first position. The vacuum mechanism is configured to move between a first position above an upper surface of each rotary drum and in contact with the leading edge of the bottommost insert, to a second position below the upper surface of each rotary drum. The vacuum mechanism releases the vacuum upon contact of the leading edge of the bottommost insert with the rotary drums. When the separator hook is in the second position, the leading edge of the bottommost insert is engaged between the gripper seat and the spring loaded bottom seat during a closing operation of each gripper assembly such that the bottommost insert is removed from the vertical stack.

It is yet further desirable to provide a rotary insert feeder and related method for processing irregularly stacked inserts. The rotary insert feeder includes a stacker for containing the irregularly stacked inserts. The stacker includes a pair of vertical side supports, a bottom plate disposed between the vertical side supports, an insert thickness detector, a back support stack assist assembly. The back support stack assist assembly includes a tamper bar in operable connection with a processor. The tamper bar is configured to tamp the stack at a predetermined frequency such that a leading edge of the bottommost insert is positioned for removal from the stacker below the bottom plate. A holdback vacuum contacts the second bottommost insert during removal of the bottommost insert, such that the second bottommost insert is not removed at the same time as the bottommost insert. The predetermined frequency is based on a thickness measurement obtained by the insert thickness detector.

It is further desirable to provide a method for initializing a rotary insert feeder for processing of inserts. The method includes measuring a length of a first insert delivered from a vacuum belt assembly to a collating track. The collating track includes leading and trailing pusher pins with a predetermined spacing therebetween. The method includes calculating, by way of a control processor, a first distance between a trailing edge of the first insert and a first trailing pusher pin. The measured length of the first insert and the predetermined spacing between a first leading pusher pin and the first trailing pusher pin are used in the calculation. An offset is established for the rotary insert feeder start position based on the calculated first distance between the trailing edge of the first insert and the first trailing pusher pin. During a restart of the rotary insert feeder, a rotational position of the rotary insert feeder relative to a position of the first pusher pin based on the established offset is adjusted by way of the control processor. A second insert is fed from the vacuum belt assembly to the collating track such that a second distance between a trailing edge of the second insert and a second trailing pusher pin is the same as the previously calculated first distance for the first insert.

The advantages and novel features are set forth in part in the description which follows, and in part will become apparent to those skilled in the art upon examination of the following and the accompanying drawings or may be learned by production or operation of the examples. The advantages of the present teachings may be realized and attained by practice or use of the methodologies, instrumentalities and combinations described herein.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1:
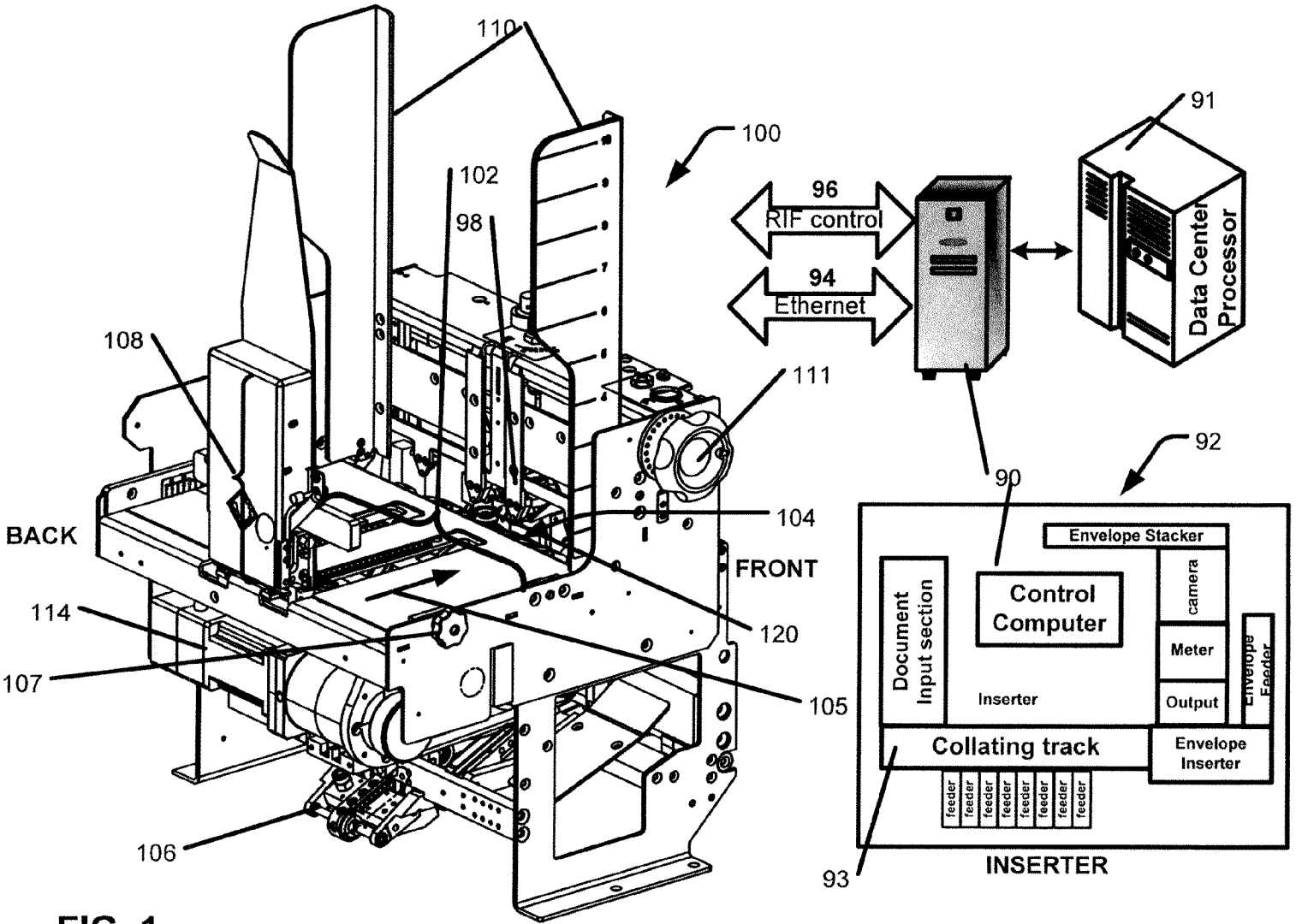
FIG. 1 is an exemplary illustration of the rotary feeder from a back perspective.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and circuitry have been described at a relatively high-level, without detail, in order to avoid unnecessarily obscuring aspects of the present teachings.

In certain examples, the rotary insert feeder (RIF) is a servo motor driven electro-mechanical assembly which synchronously deposits a variety of mailing envelope contents (or "inserts") onto the moving transport of mail processing systems or equipment. The RIF accepts a wide range of inserts that include single sheets (cut and flats), folded sheets, booklets, business return envelopes (BRE's), and others. The RIF uses a closed-loop servo motor and controller to electronically gear the feeder's motion in synchronization with encoder signals associated with the motion of the moving transport.

The RIF is an assembly comprised of electrical, mechanical, and software components which produce a rotary motion insert delivery mechanism. In certain examples, the mechanical components consist of a 21-inch circumference rotating drum, one pair of cam actuated insert gripper jaws, a cam actuated vacuum singulation sucker cup lift/retraction mechanism, and a cam actuated insert guide/separator mechanism. In certain examples, the electrical components include a servo motor/controller with external encoder interface, discrete I/O hardware interface to the control system for photo sensor signals and air/vacuum valve timing control signals, a power input such as a 208 VAC 50/60 Hz input, and a safety interlock interface compatible with mail processing equipment/systems. The software components can include, but are not limited to, an Ethernet interface between the servo controller and the control system for a message commanded alignment/synchronization of each feeder drum with the position of a transport below each feeder, and servo controller software for a synchronized mode of feeder motion plus an alternately enabled manual mode of feeder operation by operator command.

An example of a feeder drum surface transport speed will now be described. The 21 inch circumference feeder drum will synchronize its linear surface speed to the linear surface speed of the external moving transport via the electronic gearing provided by the servo motor controller external encoder input. The external encoder should provide 1800 pulses per revolution from channels A and B for a combined rate of 7200 pulses per revolution in quadrature. The maximum rate for the external encoder signal input to the feeder is 3.89 encoder shaft revolutions per second (one encoder shaft revolution=one feeder drum revolution). The feeder drum operates within a range of speed of 0 to 3.89 revolutions per second which provides for a 0 to 82 inches per second insert transport speed at the drum surface. This speed range corresponds to an insert feeding rate of 0 to 14,000 inserts fed per hour or 257 milliseconds per insert fed at the maximum 14,000 inserts per hour feed rate.

An example of an insert hopper of the RIF is now described. The RIF material hopper includes adjustable side and rear guides for supporting a vertical stack of inserts. A movable "breaker plate" provides a bottom of the stack support that permits a variable amount of unsupported insert material overhang to be presented to the fixed front surface of the hopper. The fixed front surface of the material hopper includes adjustable separator pins and air burst nozzles to facilitate the separation of individual inserts from the stack as one or three vacuum sucker cups pull the overhanging edge of the bottom insert material away from the stack. A retro-reflective photo sensor provides a "Low Stack" sensing feature for the material hopper. The sensor is active (output high) when hopper material is blocking the beam path to the reflector (i.e. logic high=not low stack).

Attention is now directed to an example of the feeder drum. The RIF drum contains a single dual jaw mechanism that opens and closes in response to mechanical cam actuated timing. The open jaws close down on an insert that is positioned at the drum surface by the downward pivoting vacuum sucker cup mechanism. The drum rotates away from the hopper stack, pulling a single insert from the bottom of the hopper stack and releasing the insert into the lower belt transport area of the feeder for final synchronous transport into the moving external transport below the feeder.

The RIF is configured to perform insert singulation. The insert hopper contains adjustable separator pins and air blast nozzles to facilitate the singulation of a single insert from the bottom of the hopper stack. The separator pins and air flow are connected to adjustment knobs marked with a graduated scale to allow for a wide range of pin exposure and air flow. The adjustment knobs are located at the top of the front fixed surface of the hopper. The vacuum sucker cups pivot up to and away from the bottom of the hopper stack in response to mechanical cam actuated timing. Each of the individual sucker cup mechanisms is knob adjustable to set the relationship between the lead edge of the insert and the outside diameter edge of the sucker cup and to adjust the limit of upward travel of the sucker cup into the bottom of the hopper stack. The vacuum sucker cup should be adjusted with the goal of obtaining a leak free seal of the cup on to the bottom insert in the hopper stack while avoiding unacceptable vertical displacement of the stack by the impact of the sucker cup into the stack. The insert retrieved by the vacuum sucker cup also receives guidance from a pivoting separator hook mechanism which is driven by mechanical cam actuated timing. The separator hooks assist in separating a single insert from the bottom of the hopper stack by supporting the remaining inserts in the stack. The separator hooks also assist in bending the insert along the contour of the drum to facilitate the jaw closing on the insert An example of the synchronous operating mode of the RIF is now described. The RIF has two distinct modes of operation. The default operating mode of the RIF is one of synchronous drum motion with respect to an external transport below the feeder. In this synchronous operating mode or gearing mode, vacuum sucker cup timing, air blast timing, and drum velocity are not operator controlled, but are dictated by the position and velocity of the external transport motion as derived from encoder signals associated with the transport. A feature of this mode is the initial indexed rotation of the feeder drum into its initial starting position in alignment with the external transport, permitting the deposit of an insert at a precise distance in front of the external transport's pusher pins.

An example of the manual operating mode of the RIF is now described. The operator is also able to select a manual operating mode where the feeder synchronous motion is suspended and drum movement is commanded by operator intervention, e.g., through the pressing of a pushbutton. The control system software should be commanded to be in the stop state in order for the RIF to function in the manual operating mode. This manual operating mode has the additional feature of having the vacuum sucker cup and air blast timing control on or off while the drum is manually commanded to turn. In the manual operating mode, the sucker cup vacuum and air blast control is turned on and off by a two position rocker switch. The operator uses the manual operating mode with vacuum sucker cup and air blast turned on, to validate the stack singulation and material handling of the feeder. The operator may also turn the vacuum and air blast off to clear material jams or when it is desired to cycle the feeder without material being transported. The feeder drum is limited to a velocity of about one revolution per second in the manual operating mode. When the control system software is commanded to return to the run state, the feeder automatically returns the drum into a synchronous position with the external transport and the feeder reverts to the synchronous operating mode.

A miss-feed sensor can be included on the RIF. One sensor example includes a retro-reflective photo sensor that is mounted just below the bottom of the hopper stack where the moving drum starts transporting the insert away from the stack. The function of the sensor is to detect the presence of the insert being pulled by the rotating drum from the stack by the control system software. A miss-feed is declared when the sensor beam is not blocked by the insert being pulled by the moving drum (logic high=beam blocked). The feeder drum position dictates when the sensor beam is being monitored, to detect sensor beam blockage only when the insert is being pulled. As an example, the sensor has a first light indicator, such as an LED, which turns on when the sensor output is active (logic high) and a second indicator LED which turns on when the sensor beam has sufficient gain adjustment and correct alignment with the accompanying reflector.

In certain examples, the RIF further includes an insert thickness sensor. A lever arm, a caliper wheel, and a rotary hall-effect sensor comprise a document sensor assembly that terminates at of the feeder electrical enclosure. The purpose of this sensor assembly is to measure the thickness of insert material passing between the caliper wheel and the feeder drum. The caliper sensor assembly is designed to detect double documents within the range of single document thicknesses, e.g., of 0.003 inches to 0.1875 inches (3/16"). The caliper lever arm is attached to the shaft of a rotary hall-effect sensor with an analog output. The rotary sensor, for example, provides a full scale +9.9 Vdc output (+0.1 to +10.0 Vdc) across the full 50° range of CW rotation of the sensor shaft. The sensor measuring system, for example, provides 4069 bits over the +9.9 Vdc range yielding 2.417 mV per bit or 0.0122 degrees per bit for the 50° range. The sensor output slope, for example, is a linear 0.198 volts per degree.

As the caliper wheel is displaced (lifted) away from the feeder drum by a document being fed, the sensor shaft rotates clockwise as the sensor's analog output increases from its initial value where no material is between the caliper wheel and the feeder drum. Thicker documents in the caliper result in a greater increase in sensor output voltage from the initial value. The control system software and with the analog input provide an analog-to-digital (A/D) conversion of the sensor's analog output. This conversion is expressed in the following equation:

(sensor voltage output/10.83 Vdc)*1023
counts=binary value for the particular sensor voltage output A "double document" is declared when the sensor output binary value is more than the 50% threshold of the difference between the binary value associated with a single document (or insert) in the caliper and the binary value with no insert. For example, if the binary value is 25 for no document in the caliper and the binary value is 50 for a single document in the caliper, then the "double document" detection threshold is the binary value or 63. This relationship is expressed in the following equation:

[single document binary value+(0.5*(single document binary value−no document binary value))]+1=double document detection threshold binary value A "material error" is declared when the sensor output binary value is less than the 50% threshold of the difference between the binary value associated with a single insert and the binary value of no document (or insert) in the caliper. Using the same example above, a "material error" threshold is the binary value of 37. This is represented as follows:

[single document binary value−(0.5*(single document binary value−no document binary value))]−1=material error threshold binary value The operator panel sensor diagnostic screen may be accessed to read the binary value associated with the sensor's output. This binary value also increases in response to thicker documents in the caliper. When factoring in specifications for accuracy and repeatability for the A/D conversion and the sensor's analog output, the binary values displayed will have a +/−2 count tolerance.

The geometry associated with the caliper lever arm movement and the rotation of the sensor shaft is not a perfect linear relationship. Therefore, it is not valid to expect a linear relationship between caliper arm inches of displacement to the sensor shaft degrees of rotation and its associated sensor voltage output. The caliper is designed to detect a double document after a calibration with a single document has been performed. Each single document will have a unique sensor voltage output and a respectively unique associated binary value in control system software.

An example of the single document calibration is now discussed. The mounting of the caliper assembly slightly pre-loads the lever arm return spring as the caliper wheel rests against the feeder drum. The caliper assembly is properly mounted on the feeder if the sensor output measures +0.25 Vdc (+/−0.1 Vdc) when there is no material between the caliper wheel and feeder drum. The operator panel may be used to access the service sensors function to view the corresponding binary value associated with the sensor output voltage. The binary value displayed should be a value of 14 to 33 when the caliper wheel is at rest against the feeder drum and there is no material between the caliper wheel and feeder drum. The operator begins the document thickness calibration by selecting the feeder setup mode at the control system operator panel. The feeder's LED indicator can exhibit a 3 fast and 1 slow flashing pattern, or other pattern, when the set up is required. Next, the operator commands the external transport below the feeder to move. The feeder initially executes an offset move to align the drum jaws in a position to permit the document to be synchronously deposited on the transport. The feeder then pulls a single document from the hopper stack and deposits the document on to the transport below the feeder as the transport moves. While the feeder is in motion, the document passes through the beam of the output sensor and the length measurement is taken. Also, as the document passes through the double document caliper wheel and feeder drum gap, the thickness of the single document is sampled. Documents in the transport during set up are transported away for retrieval by the operator so that they can be verified as a true single document. If the feeder has pulled a double document, the set up process should be repeated.

In certain examples, the RIF is equipped with an output and insert length sensor. A retro-reflective photo sensor terminates at of the feeder electrical enclosure. The primary function of this dual purpose sensor is to detect the presence and movement of the insert in the lower belt transport (output) of the feeder. Control system software monitors this sensor as a means of jam detection in the feeder (logic high=beam blocked). The secondary function of the sensor is to measure the size of the insert by tracking the encoder counts while the sensor beam is blocked. The encoder counts are converted to a measurement standard, e.g., inches, in the control system software to ultimately create an insert dimension value. This dimension is used as a value in the equation that determines the amount of initial indexing motion or offset that the drum will make during the control system controlled feeder setup mode. The drum should be oriented with a specific amount of offset to permit the deposit of the insert just in front of the external transport pusher pins. Once the offset is made, it does not change during the remainder of the usage of a particular size of insert in a system job. A new measurement of insert dimension and a new drum offset is determined when a new job is selected for the system. This sensor's signal is also monitored by the servo controller software. The sensor has a light indicator, such as an LED of a first color, which turns on when the sensor output is active (logic high) and a second indicator, such as a second color LED, which turns on when the sensor beam has sufficient gain adjustment and correct alignment with the accompanying reflector.

Examples of a feeder drum and a servo "home" sensor of the RIF are now described. The function of a hall-effect sensor is to detect the location of a single magnet attached to the feeder drum. The magnet defines a single drum position that is designated "home" by the servo controller software. The "home" position becomes a known zero count value for the motor encoder and associated feeder drum position and a reference zero starting position for the servo controller software. This sensor's signal is not monitored by the control system software.

In certain examples, a low stack sensor is provided on the RIF. For example, a retro-reflective photo sensor is mounted toward the bottom of the material hopper stack within the feeder hopper side guides. The sensor and accompanying reflector are able to be adjusted for differing low stack levels of insert material. The function of the sensor is to detect the presence and absence of the insert material in the hopper stack by control system software. A low stack condition is declared when the sensor output is not active and the sensor to reflector beam path is NOT blocked by insert material in the hopper (logic low=low material stack in hopper). The sensor has an indicator, such as a first colored LED, which turns on when the sensor output is active (logic high=hopper material blocking beam path) and a second colored indicator LED which turns on when the sensor beam path has sufficient gain adjustment and correct alignment with the accompanying reflector.

Examples of sucker cup vacuum valves of the RIF are now described. The feeder uses two air flow valves to control the vacuum air flow to one center and two outside center sucker cups. Control system software controls the open and closed state of the valves when the feeder is operating in the synchronous operating mode. The servo controller controls the state of the valves when the operator has selected the feeder's manual operating mode. In both modes, a single output controls the open and closed timing of the two valves that supply vacuum to three sucker cups. A second "dual vacuum" output, only supplied by system control, energizes electrical enclosure relay to route the sucker cup valve control signal to the second vacuum valve for additional vacuum flow control of the two outside center sucker cups. The valves terminate with a dedicated two position connector and wire assembly that is connected to the electrical enclosure hardware. Each valve has an indicator, such as an LED or other light indicator, which turns on when vacuum air flow is active at the sucker cup.

The RIF can further include a belt transport vacuum valve. The feeder has a third vacuum air flow valve to support the vacuum belt transport located at the final exiting stage of the feeder which is controlled by the servo controller software. The vacuum belt assembly is designed to stabilize and prevent skewing of the document at the point where the external transport pusher pins acquire the document that is exiting the feeder. The valve terminates with a dedicated two position connector and wire assembly that is connected to electrical enclosure hardware. The valve also has an indicator which turns on when vacuum air flow is active at the belt.

In certain examples, the RIF includes an air flow/blast valve to control a burst of air emitted by nozzles located at the fixed front surface of the material hopper. Control system software synchronously controls the open and closed state of the valve when the feeder is operating in the synchronous operating mode. The servo controller controls the state of the values when the operator has selected the feeder's manual operating mode. The valve terminates with a dedicated two position connector and wire assembly that is connected to electrical enclosure hardware. The valve also has an indicator which turns on when air flow is active at the nozzle.

In certain examples, the RIF includes a stack assist valve. The feeder uses a second air flow valve to control the motion of an air cylinder that is integrated into the material hopper adjustable back stop. The air cylinder actuates the in/out motion of a bar which tamps the vertical stack of documents in the hopper. The stack assist tamping bar manipulates the documents in the stack by forcing their alignment against the fixed front surface of the material hopper. The uniform alignment of documents against the fixed front surface of the material hopper promotes reliable document singulation. Control system software synchronously controls the open and closed state of the valve when the feeder is operating in the synchronous operating mode. The valve terminates with a dedicated two position connector and wire assembly that is connected to electrical enclosure hardware. The valve also has an indicator light emitting diode (LED) which turns on when air flow has moved the tamping bar against the document stack.

A hold back valve of the RIF is an example of a fourth vacuum air flow valve that supports the vacuum hold back assembly located below the material hopper of the feeder which is controlled by the control system software. The hold back assembly is designed to prevent the "next to bottom of the stack" document from slipping away from the stack and following the current document that is being pulled away from the stack. The valve terminates with a dedicated two position connector and wire assembly that is connected to electrical enclosure hardware. The valve also has an indicator which turns on when vacuum air flow is active at the hold back assembly.

A servo motor controller of the RIF is programmed with embedded software which manages the synchronous motor control motion, manual motor control motion, operation of pneumatic valves in the manual operating mode, and the communication interface, such as the Ethernet. The servo controller communication interface allows an external control system to execute pre-defined programs defined by a logic state, set certain control parameters, and retrieve status information. An example of the physical medium for communication with the servo controller includes an Ethernet TCP/IP link. A CAN to Ethernet gateway module can be used to link the communication interface to the control system. The RIF is a closed-loop servo controlled mechanism driven, for example, by a 300 Vdc servo motor and attached 10:1 ratio gear box pairing. The gear box output shaft pulley drives a timing belt linkage to a pulley on the feeder drum. This additive 1.2 to 1 pulley ratio creates a complete drive ratio of 12 motor shaft revolutions to 1 feeder drum revolution. The incremental encoder in the motor provides 8000 encoder pulses (in quadrature) per motor revolution. This results in the servo controller in the electrical enclosure receiving 96,000 encoder pulses (in quadrature) per 21 inch feeder drum revolution. For a maximum feeder drum velocity of 34.8944 revolutions per second (14,000 inserts fed per hour), the motor will operate at just less than 2800 rpm maximum speed.

Attention is now directed to the setup and adjustment for the RIF. The rotary feeder is a vacuum separation device which singulates inserts from a stack and uses gripper devices mounted to a circular drum to remove the singulated insert from the bottom of the stack. The rotary motion of the drum is used to place the insert into the collating track through the controlled release of the gripper device. A belt mechanism, which includes a vacuum belt, transitions the insert from the drum to the collating track. There are a wide variety of inserts as indicated by format (size), thickness, porosity, and coating which should typically be fed from such a device. In addition, inserts made of paper exhibit variation such as curl or warp, due to environmental factors. For these reasons, it is important that the feeder device be flexible in its setup. However, because of varying skill level of any given operator, the rotary feeder should be relatively easy to setup and operate. This feeder has approximately 10 variables which are configurable based on the properties of the insert. These variables include:

1. Selection of vacuum cup. Certain cups are optimum for different insert properties. For instance, a larger cup will aid in bending stiffer material to the drum, but may not be optimum for a thin porous insert.
2. Vacuum cup height is adjustable. Different vacuum cups often require different heights. So having different heights allows the use of different cups or cups which are better suited to the application. Adjustable cup height is also useful for dealing with warped or curled material or stacks in which the material does not register well to the bottom.

3. Vacuum cup lateral position is adjustable. Different materials have different stiffness and different porosities and can benefit from an optimized cup location.
4. Cup angle is adjustable. Varying the cup angle can be useful to achieve sealing of the vacuum cup when material is curled or warped.
5. Breaker Plate position is adjustable. Allows more or less support for the material stack as required to process the material.
6. Blow Air volume is adjustable. Allows compensation for the porosity or stiction properties of the material stack,
7. Restrictor pins are adjustable. The restrictor pin length into the stack is adjustable as necessary to allow singulation and prevent doubling for the various material types.
8. Side restrictor pins can be In or Out. Certain flimsy materials benefit from the support provided by these pins.
9. Smart Stack Assist is selectable On or Off. This is a Job parameter.
10. Vacuum Holdbacks are selectable On or Off. This is a Job parameter.

In addition, there are side guides and a back guide which should be adjusted in the normal way for an insert format (size).

All of the adjustments listed above are calibrated and repeatable. Even the most difficult application setups can easily be recorded and repeated without having to repeat the trial and error often used by those familiar with such types of feeders. Because some of the adjustment mechanisms are small and not well suited for marking, a simple setup gauge is provided with each feeder to measure the adjustment positions of several of the adjustments. To assist in setting up the feeder, a jog pushbutton is provided for jogging the feeder, with or without material.

For those adjustments not setup manually by the operator, there are several other adjustments which are automatically set by the control system. When an operator starts a new job, the selected feeders automatically feed one insert. As the insert processes though the feeder, its thickness and length are measured. This allows the feeder to automatically calibrate the document thickness detector and also phase the feeder to the collating track for optimum material handling during operation. The thickness measurement also adjusts the rate at which the smart stack assist operates; i.e. thinner materials are tamped less frequently than thicker inserts so that the stack is not over-tamped. A simple confirmation by the operator insures that double detect is setup properly.

Reference now is made in detail to the examples illustrated in the accompanying drawings and discussed below. FIG. 1 illustrates the RIF 100 in an isometric view as seen from the back. The RIF 100 is mounted on an inserter 92 such as but not limited to the Bell and Howell COMBO®. Numerous RIFs may be installed on a COMBO® or other inserter or wrapper. Each feeder will feed inserts with different characteristics and will have different setup parameters that are determined automatically or set by the operator. Inserts are stacked on the stacker bottom plate 102 and are fed forward to the front 105 of the RIF 100 where the drum mechanism (not shown) will pick up the insert that is on the bottom of the stack. The insert is discharged onto the collating track 93 of the inserter 92 with a vacuum belt assembly 106. The stacker plate 102 is movable forward and backward to adjust the gap 104 between the stacker bottom plate 102 and the front wall of the stacker 98. A smaller gap is used for thin flexible inserts that will be easy to bend downward with the sucker cup 120. A larger gap is used for thicker inserts. The gap 104 is adjusted with knob 107. The side supports 110 are adjusted with knob 111 and the back support stack assist assembly 108 can be moved forward and backward as required. The RIF 100 is driven by a servo motor 114 which is controlled with a servo controller (not shown). An inserter control computer 90 is used for inserter subsystem control including the RIFs. The RIFs 100 are connected through communication interface (e.g., Ethernet) 94. Other RIF devices, such as but not limited to vacuum and pressure valves plus photocells, maybe interfaced by other control signals 96. Those skilled in the art will appreciate that other options such as control boards, computers and servers to interconnect and control the overall inserter(s) system(s) can be added to the overall system. The control computer 90 may be connected to a data center processor/server 91 along with other inserter control computers for job set up and for job reporting.

Figure 2:
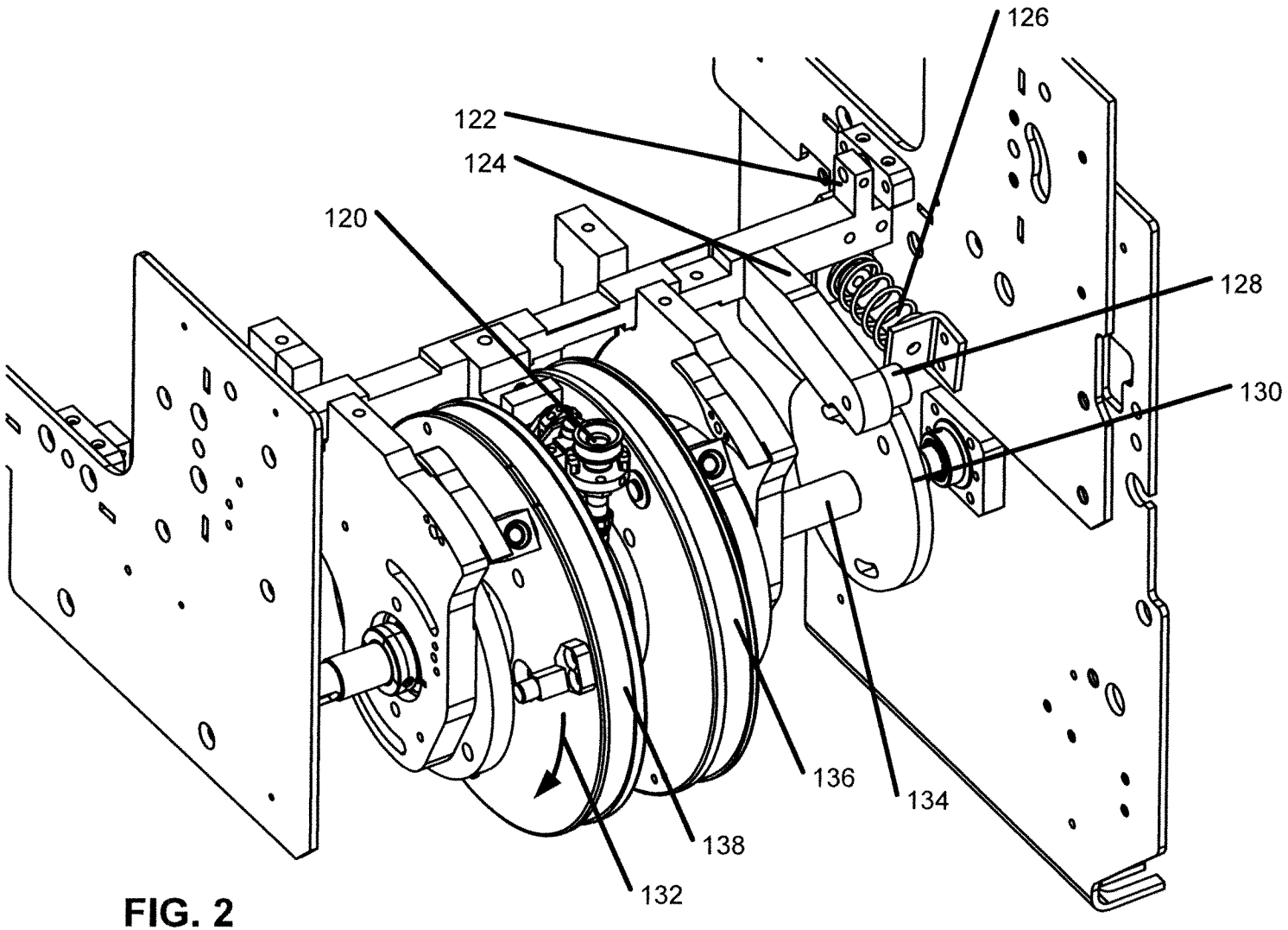
FIG. 2 is an exemplary illustration of the sucker cup in its initial up position and the cam system for controlling the sucker cup position.

Turning to FIG. 2 for an illustration of the pick off sucker cup 120 (e.g., vacuum mechanism) and the rotary drums 136 and 138 that are used to guide the insert (not shown) to the collating track 93 (FIG. 1). The sucker cup 120 moves in an up and down motion as it picks inserts from the bottom of the stack. Those skilled in the art may add additional sucker cup assemblies to the pivot bar 122 if required for the type of inserts being processed. The sucker cup 120 motion is controlled by a rotary cam 130 which is connected to the central drive shaft 134. The cam is positioned at the highest point at the central drive shaft 134. The cam high point is translated to the sucker cup 120 via a cam follower 128, a connecting arm 124 and a sucker cup pivot bar 122. The cam follower 128 is kept in contact with the cam 130 by a compression spring 126. The drums 138 136 and all cams are driven by the servo motor 114 in a clockwise rotation 132.

Figure 3:
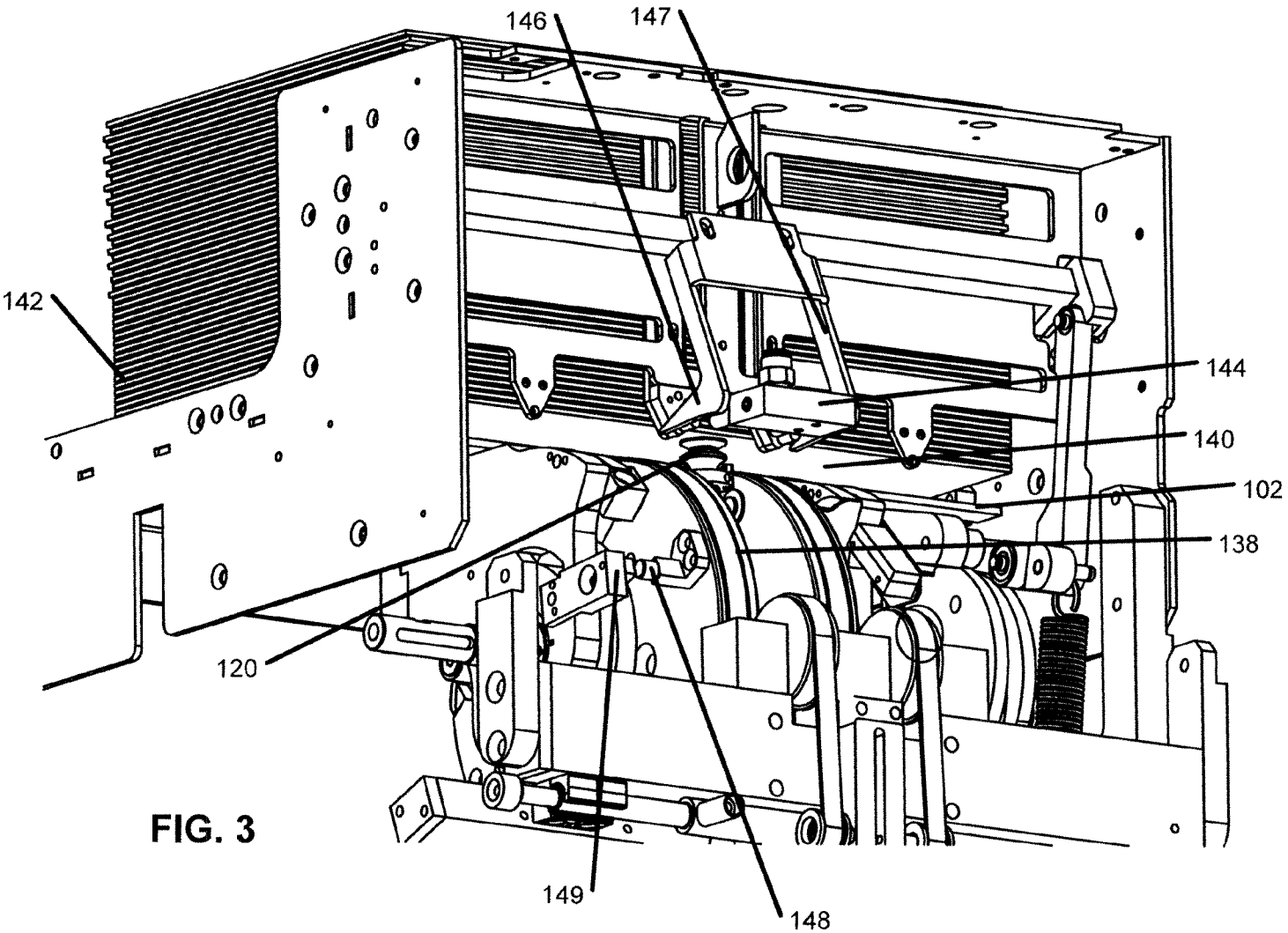
FIG. 3 is an exemplary illustration of the separator hooks in the withdrawn position.

In FIG. 3 the sucker cup 120 is in the full up position and is in contact with the bottom insert 140 of the stack 142. The sucker cup vacuum is on such that it produces a solid hold on the bottommost insert 140. If enabled, the air blaster 144 is turned on to assist in the separation of the bottom insert 140 from the next insert (i.e., second bottommost insert) in the stack 142, as the sucker cup 120 moves downward. Separator hooks 146, 147 are fully extended outward at this point in the feed cycle. FIG. 3 shows the "home" position for the RIF. The "home" position is signaled to the control system by a hall effect home sensor 149 when it is aligned with a magnet 148 attached to the drum 138.

Figure 4:
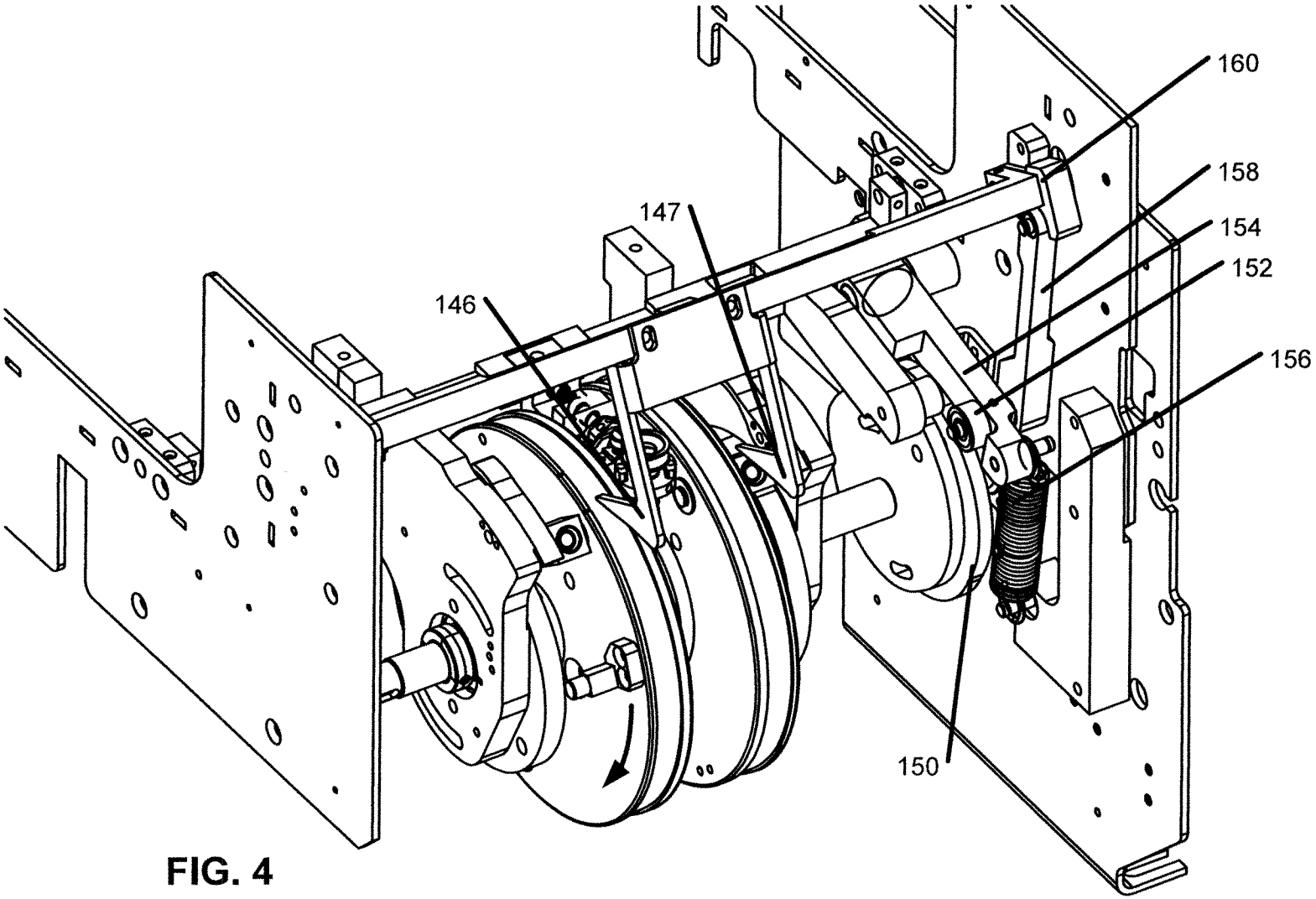
FIG. 4 is an exemplary illustration of the cam system for controlling the separator hooks.

FIG. 4 illustrates the cam assembly that controls the motion of the separator hooks 146, 147 shown in the fully extended position (i.e., away from the bottom plate and the rotary drums). The rotary separator hook cam 150 has a cam follower 152 that is attached to the separator hook cam follower arm 154. An additional connecting rod 158 translates the motion of the cam follower 152 to the separator hook pivot bar 160. The cam follower 152 is kept in contact with the cam 150 with the tension spring 156.

Figure 5:
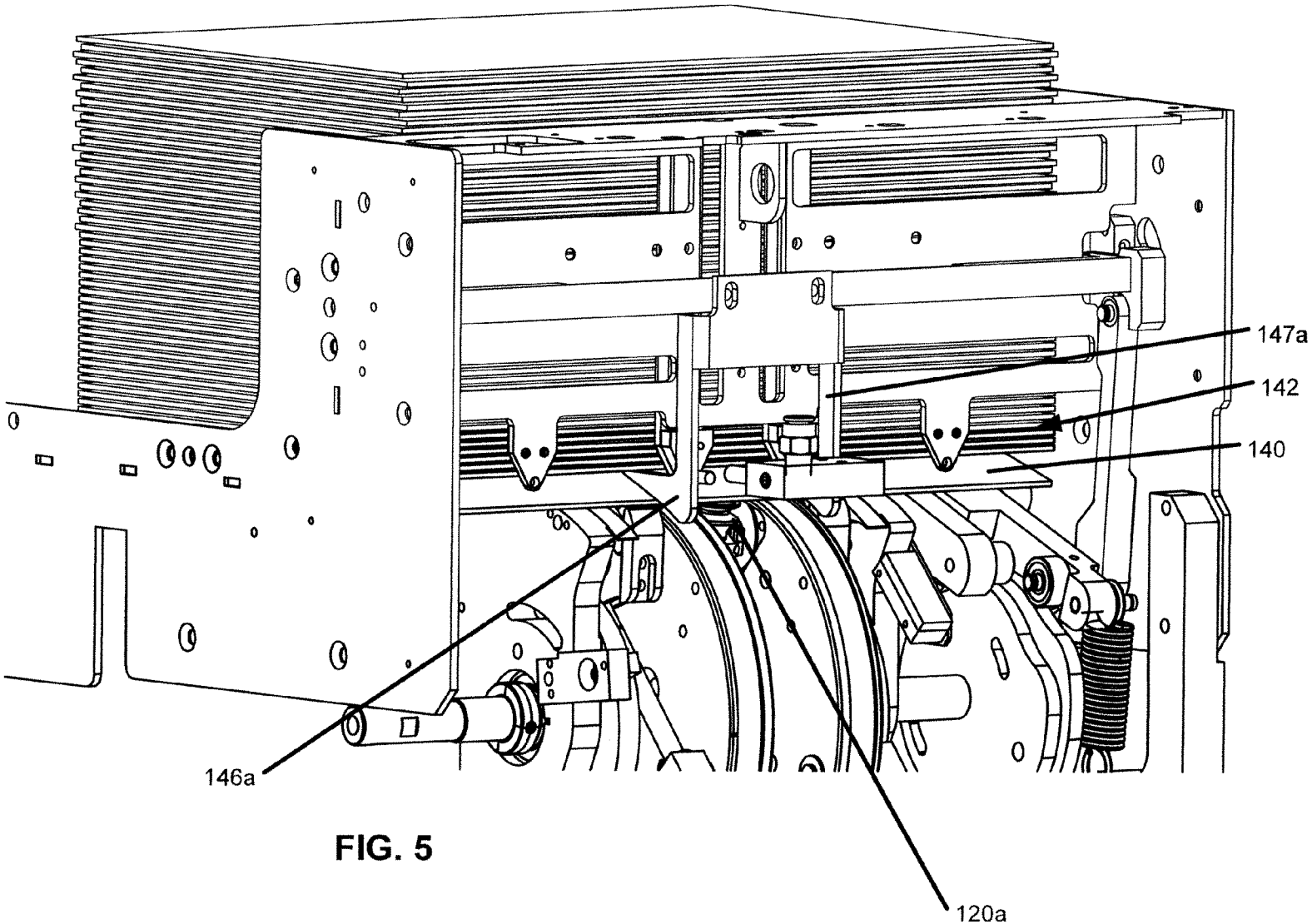
FIG. 5 is an exemplary illustration of the insert drawn down to the drum surface.

FIG. 5 illustrates sucker cup 120*a* retracted to level of the drum surface. The vacuum ensures that the bottom insert 140 has been pulled down to the drum surface. The separator hooks 146*a*, 147*a* have been moved to the fully in position (i.e., interposed between the rotary drums and the bottom plate). The separator hooks serve to keep the bottom insert 140 against the drum surface and ensure that the stack 142 does not droop down toward the drums. The bottom surface of the separator hooks 146*a*, 147*a* is curved at the same radius as the drum in order to make the bottom insert 140 conform to the surface of the drums without wrinkles or other distortions.

Figure 6:
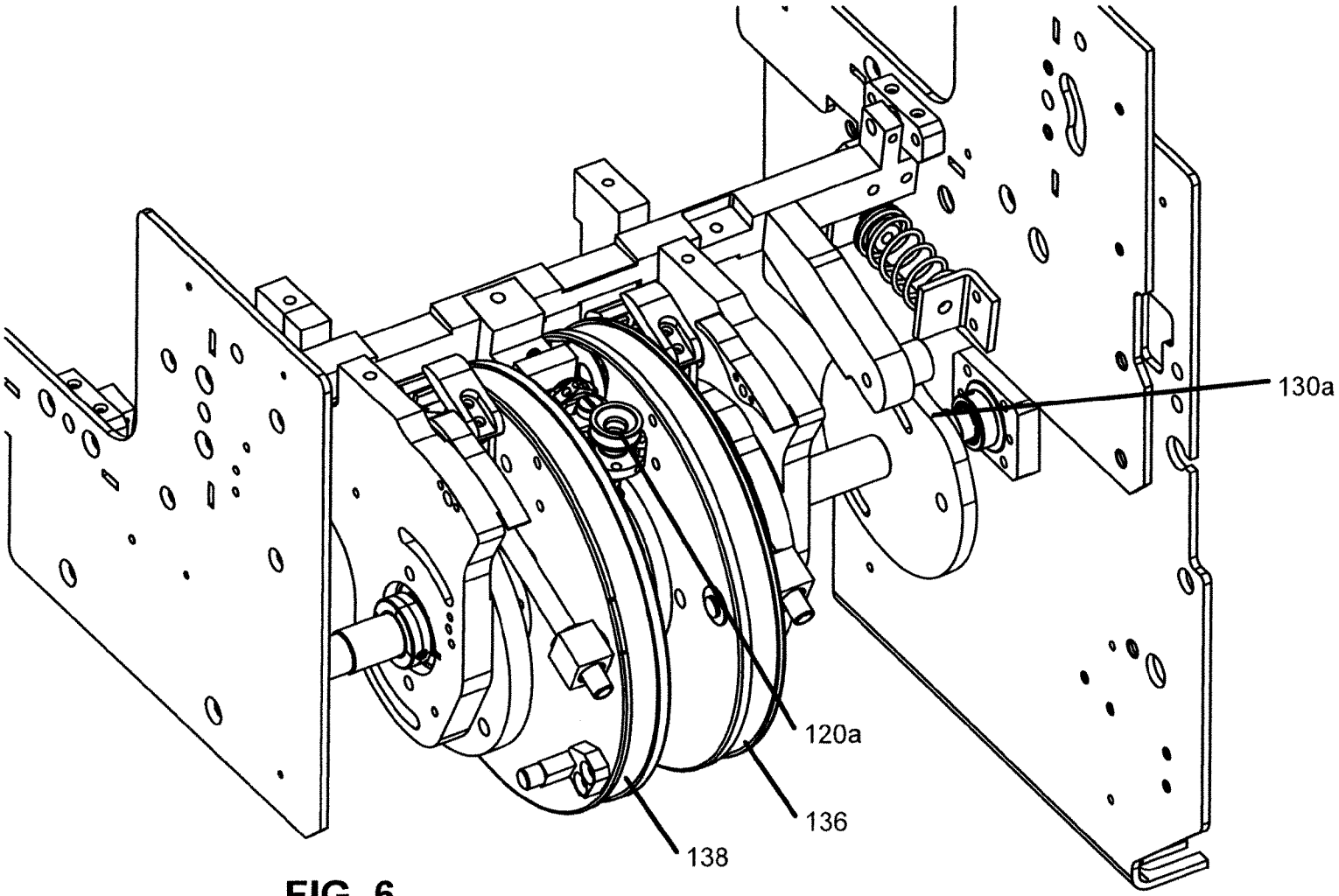
FIG. 6 is an exemplary illustration of the cam system holding the sucker cup even with the drum surface.
Figure 7:
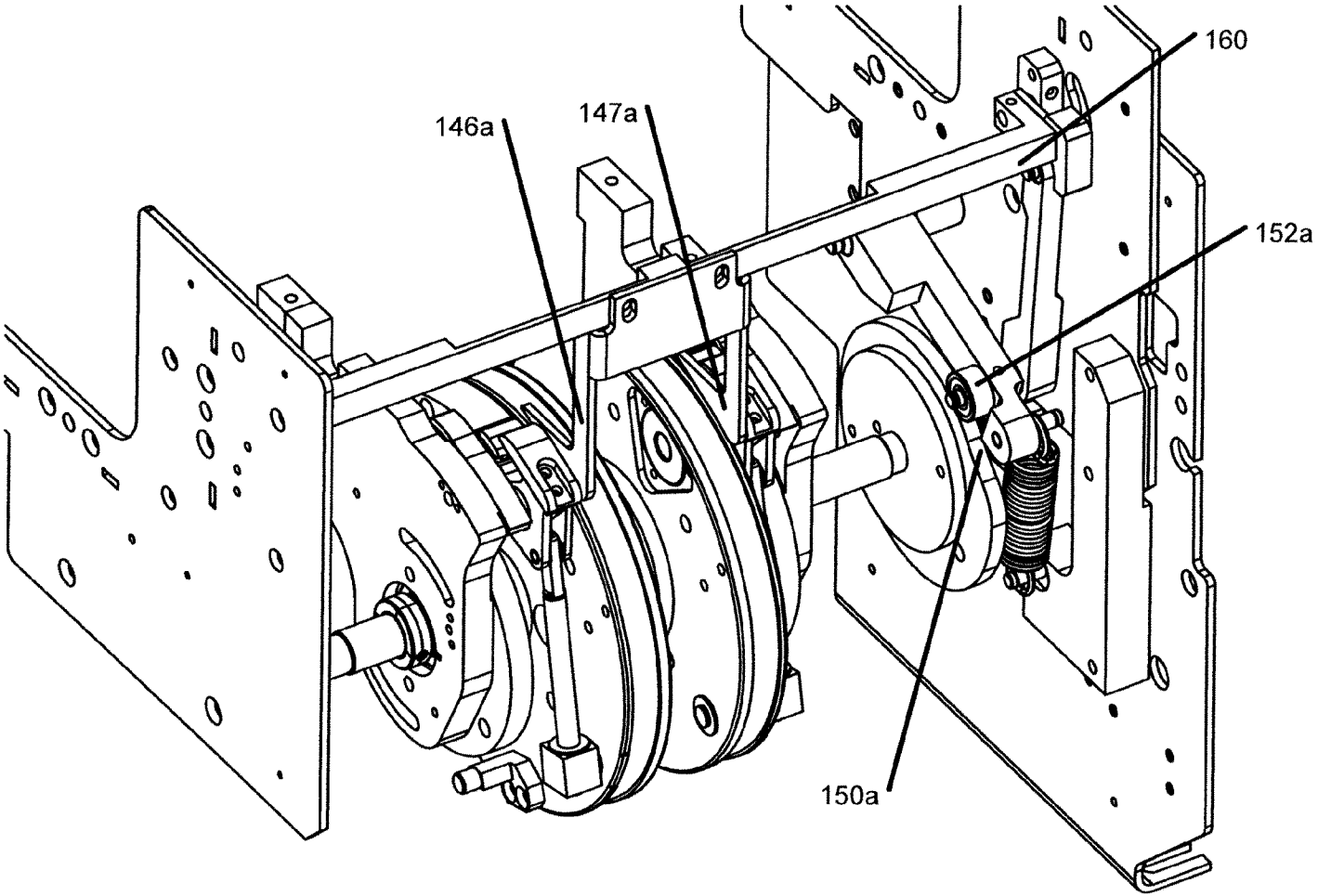
FIG. 7 is an exemplary illustration of the cam system for controlling the separator hooks in the in position.

FIG. 6 illustrates the sucker cup 120*a* at the surfaces of drums 138, 136 and the sucker cup cam 130*a* at the intermediate lower position. The cam follower linkage described above is unchanged. Similarly, the separator hooks 146*a*, 147*a* have been moved to the fully in position by the separator hook cam 150*a* reaching its lowest point in its profile, as shown in FIG. 7. The separator hook cam follower 152*a* and the accompanying linkage are unchanged from the previous description.

Figure 8:
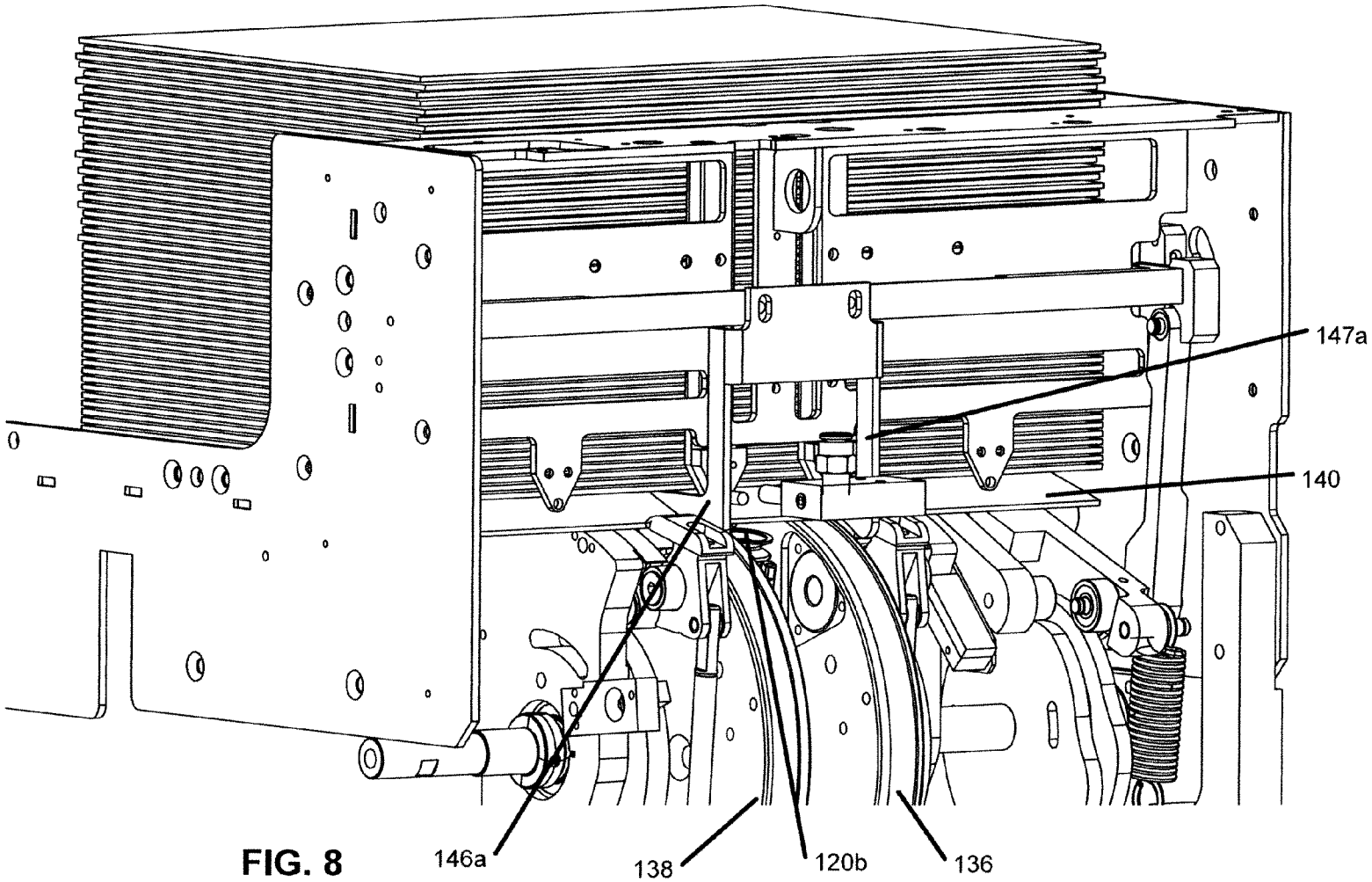
FIG. 8 is an exemplary illustration of the sucker cup drawn below the drum surface.
Figure 9:
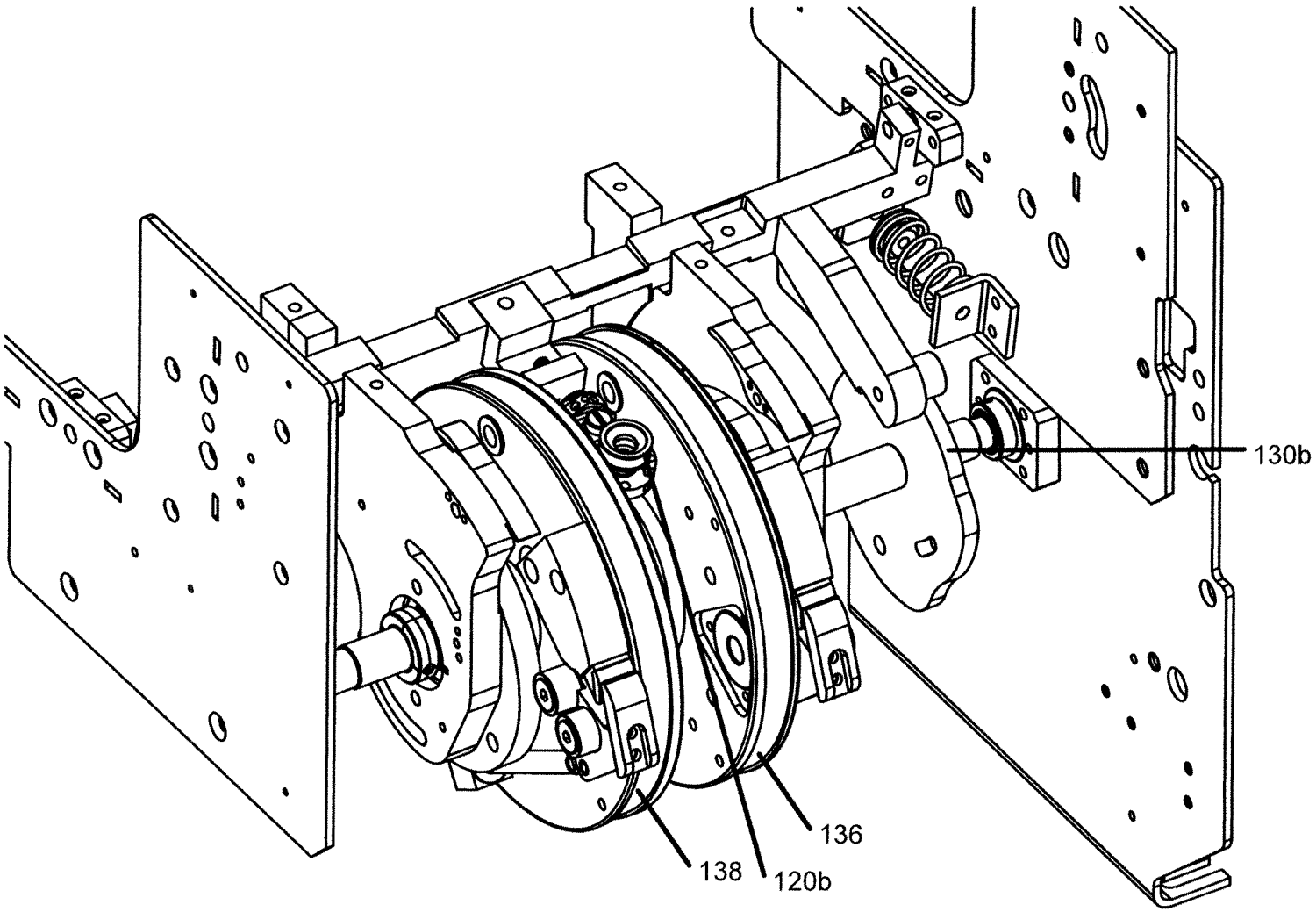
FIG. 9 is an exemplary illustration of the cam system holding the sucker cup in the down position.

FIG. 8 illustrates the sucker cup 120*b* at its lowest point below the drum surface. The vacuum has been released and the bottom insert 140 is held in place by the separator hooks 146*a* 147*a*. Throughout the range of motion of the sucker cup 120 120*a* and 120*b* the bottom insert 140 has not been drawn across the sucker cup thus avoiding damage or wear on the sucker cup. As shown in FIG. 9 the sucker cup 120*b* has been moved to its lowest position below the surfaces of drums 138, 136 as the sucker cup cam 130*b* has reached it lowest point in its profile.

Figure 10:
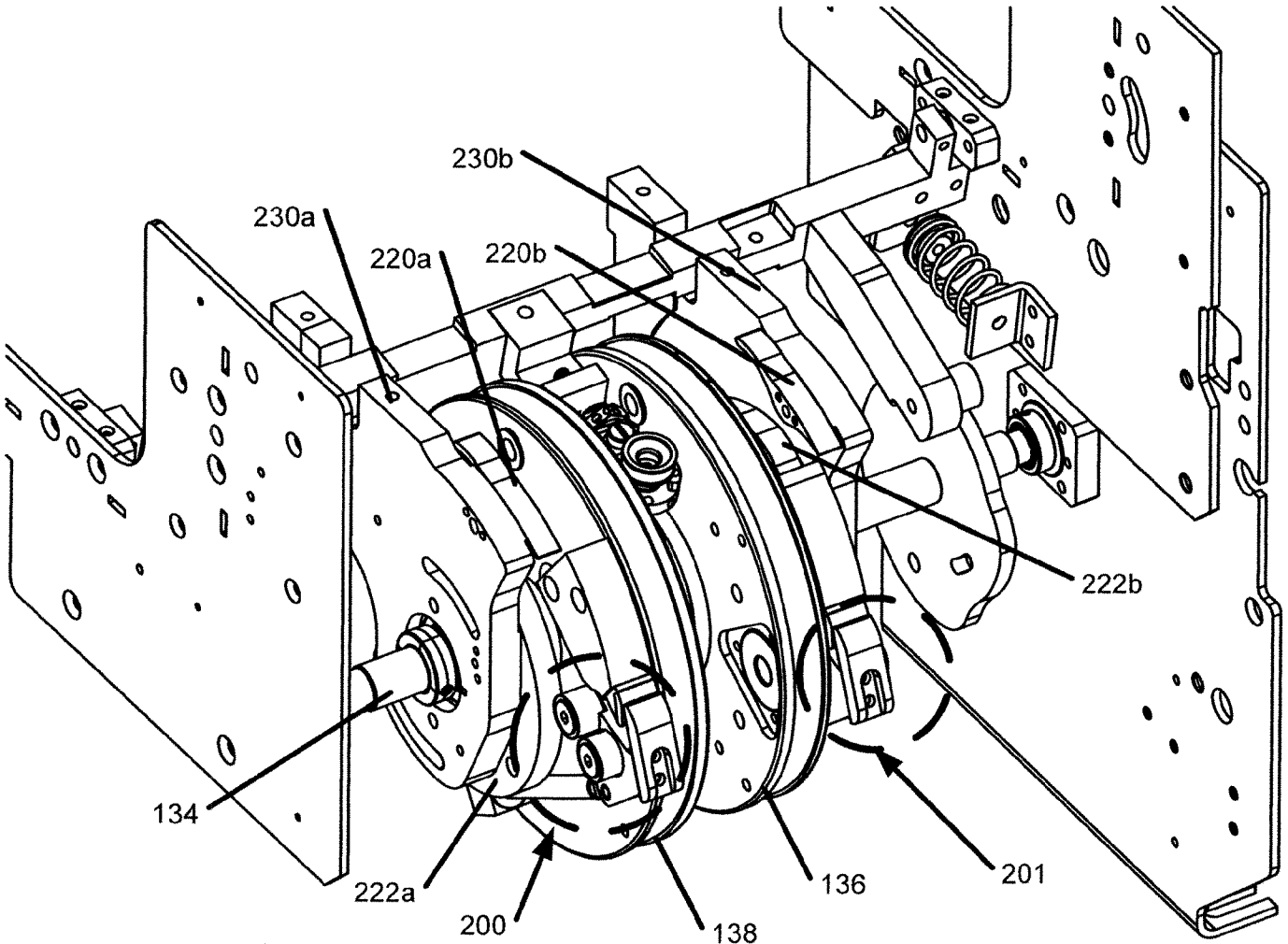
FIG. 10 is an exemplary illustration of the location of the gripper systems on the drum.

Attention is now turned to FIG. 10 to describe the operation of the gripper assemblies 200, 201 that are attached to the surfaces of drums 138 and 136, respectively. The gripper assemblies remove the bottom insert 140 (FIG. 11) from the stack and transport it through the rotary feeder. The operation of the gripper assemblies 200, 201 are controlled by the closing cams 220*a*, 220*b*, which are mounted to the drive shaft supports 230*a*, 230*b*, and opening cam 222*a*, 222*b*, which also are mounted to the drive shaft supports 230*a*, 230*b*. Neither cam rotates with the drive shaft 134. Both gripper assemblies 200 and 201 operate in synchronism but independently. As a result, insert material that does not have a uniform thickness is positively gripped by each gripper assembly. The gripping force will be adjusted automatically based on the force needed to pull the insert from the stack and on the insert thickness at the point of gripping. Refer to the description for FIG. 13 for a detailed description of the process.

Figure 11:
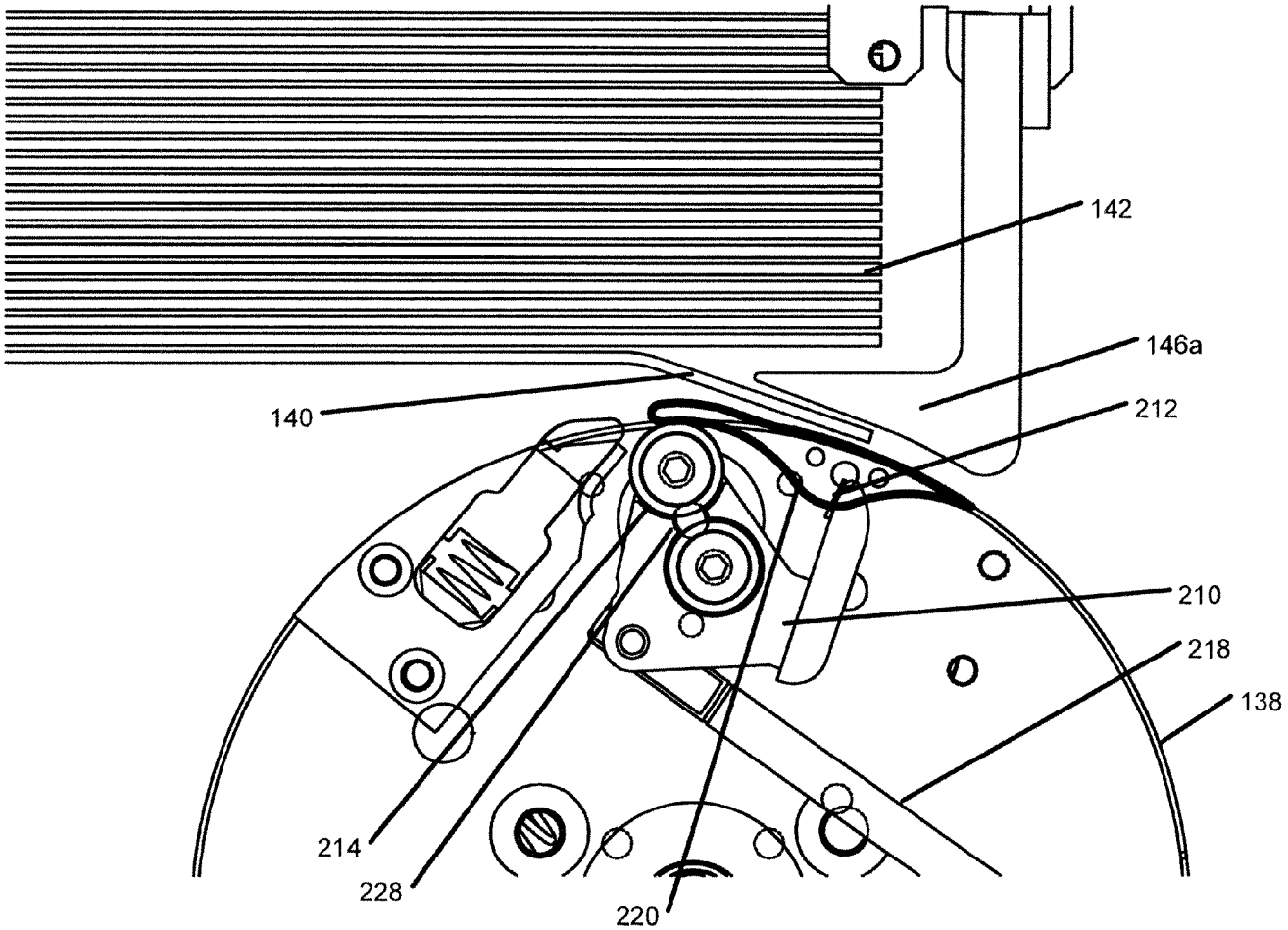
FIG. 11 is an exemplary illustration of the insert gripper in the full open position.
Figure 12:
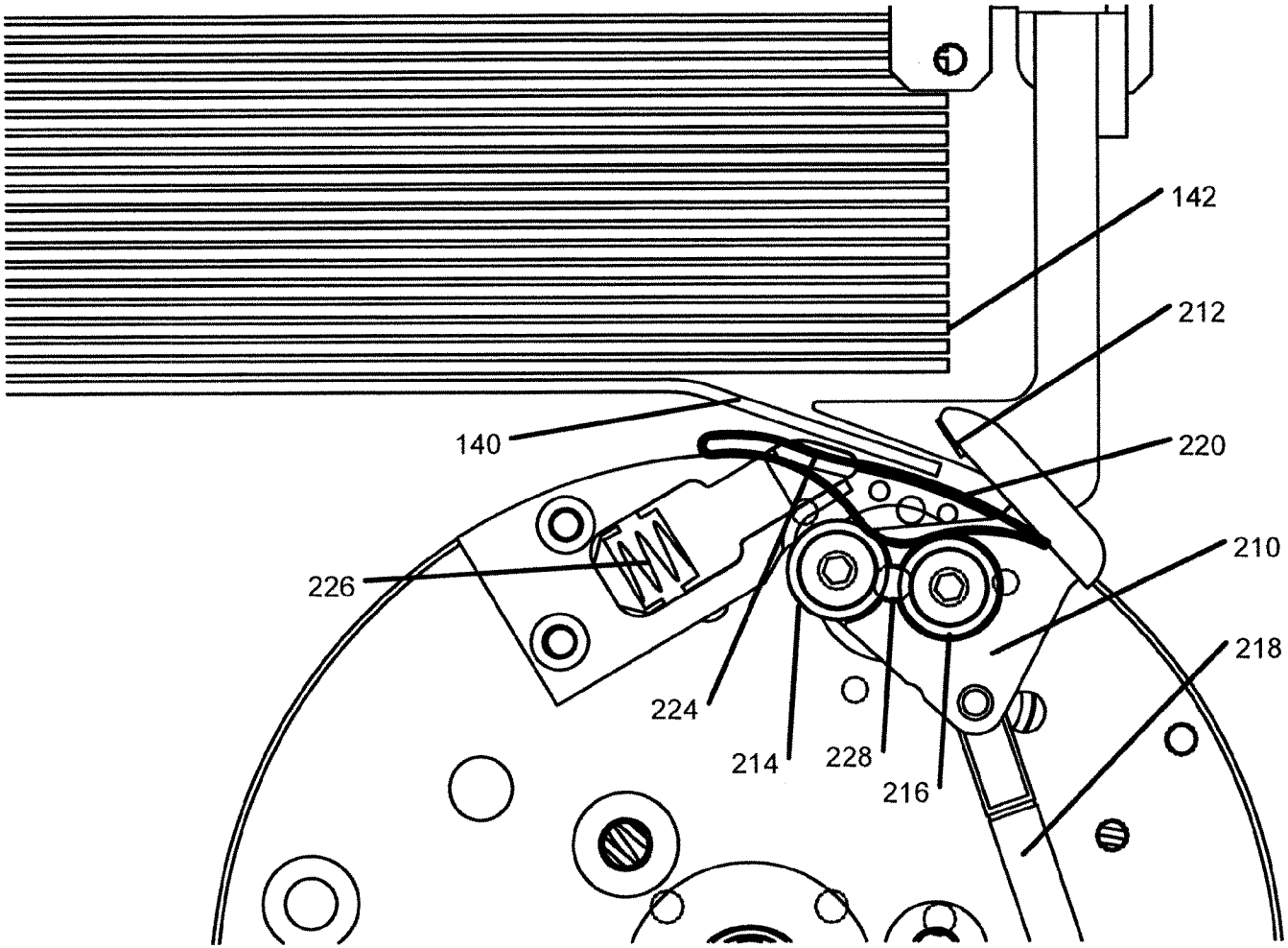
FIG. 12 is an exemplary illustration of the insert gripper in the partially closed position.
Figure 13:
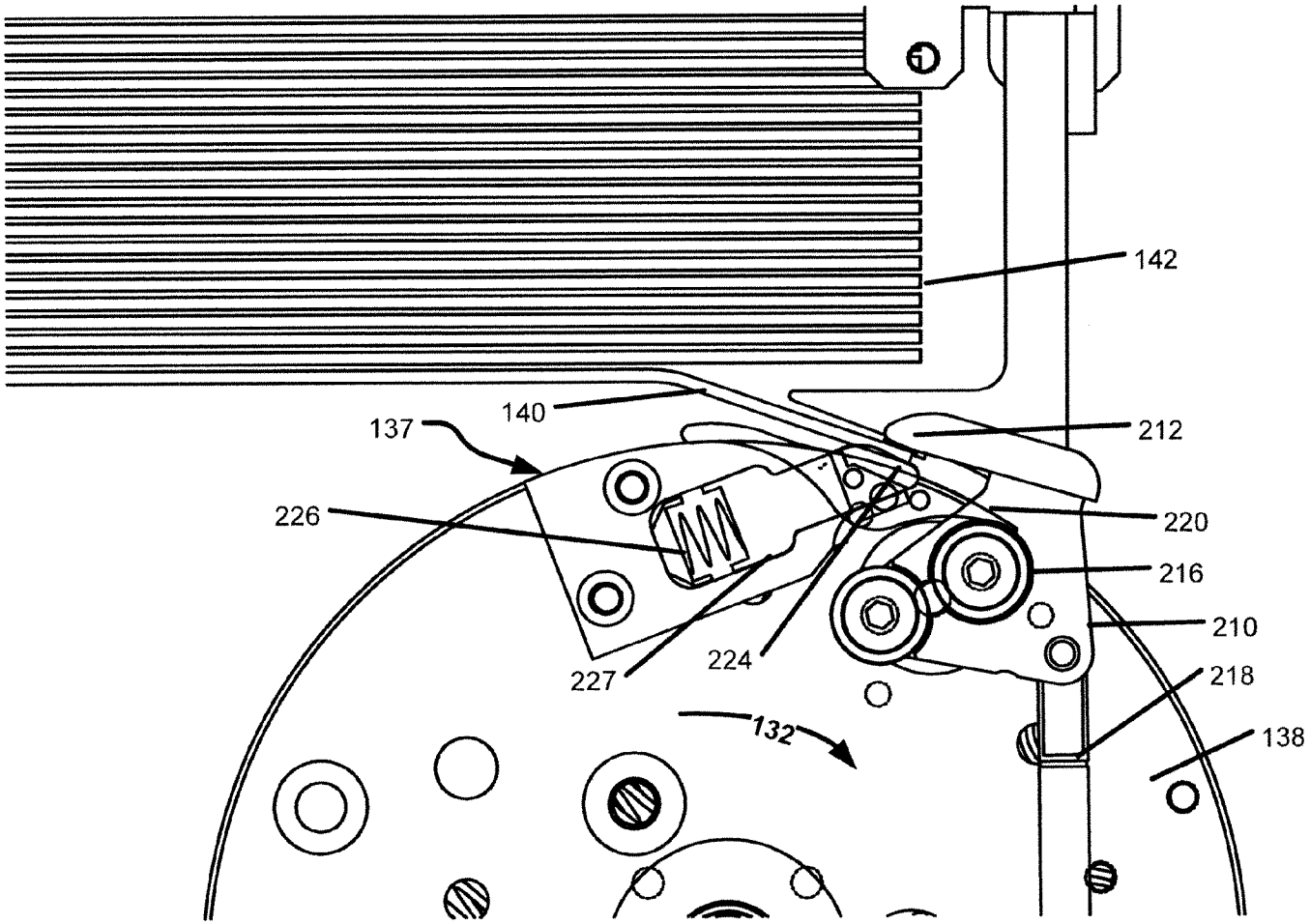
FIG. 13 is an exemplary illustration of the insert gripper in the fully closed position.

FIGS. 11, 12 and 13 are now referenced to describe the gripper assemble closing sequence. FIG. 11 illustrates the start of the closing sequence as the left cam follower 214 makes contact with the closing cam 220. The cam action initiates a counterclockwise rotation of the gripper 210 about pivot point 228 which will bring the gripper finger 212 above the drum 138 surface and the bottom insert 140. The separator hook 146*a* is holding the stack 142 up and the bottom insert 140 down. The gripper 210 has been held open by the spring loaded actuator bar 218, which is attached to the drum 138 (attachment point not shown).

FIG. 12 shows the gripper 210 halfway through the closing sequence. The gripper 210 has rotated to a point where the actuator bar 218 is to the right of the pivot point 228 resulting in the force of the actuator bar 218 to now force the gripper 210 to close the gripper seat 212 onto the bottom seat 224 trapping the bottom insert 140. The bottom seat 224 is spring 226 loaded to increase the holding force for thicker inserts and to better eliminate slippage as the bottom insert 140 is pulled out from the stack 142. The rate of closure of the gripper 210 is controlled by the action of both the right 216 and left 214 cam followers on the closing cam 220. The closing sequence should be rapid, but controlled, so that the closing action does not result in bounce and loss of positive control of the bottom insert 140.

The gripper closed position is illustrated in FIG. 13. The force from the actuator bar 218 and the action of the right cam follower 216 on the cam 220 has resulted in the full closure of the gripper 210. The bottom seat 224 and the gripper finger 212 have the bottom insert 140 firmly gripped. The drum rotation will now result in the bottom insert 140 to be pulled from the stack 142. The geometry of the bottom gripper assembly 227, which is mounted to the side of the drum 138, is oriented at an acute angle relative to the drum surface 137. As the bottom insert 140 is pulled out from under the stack 142 by the rotation 132 of the drum 138, a proportion of the force needed to overcome the friction between the bottom insert 140 and the stack 142 is transferred through the bottom seat 244 to the spring 226. As a result, the spring is compressed transferring additional gripping force between the gripper finger 212 and the bottom seat 224. Even though the bottom spring 226 has approximately a 28 lb per inch force versus the actuator bar 218 spring with a force of approximately 4.5 lbs per inch, the geometry of the gripper 210 allows the forces to balance with enhanced gripping strength. The gripping strength increases as the force needed to pull the bottom insert 140 out of the stack 142 increases. Those skilled in the art may adjust the geometry to account for other variables. However, if they use a common geometry where bottom gripper assembly 227 is close to perpendicular to the drum surface 137, the benefit is lost.

Figure 13A:
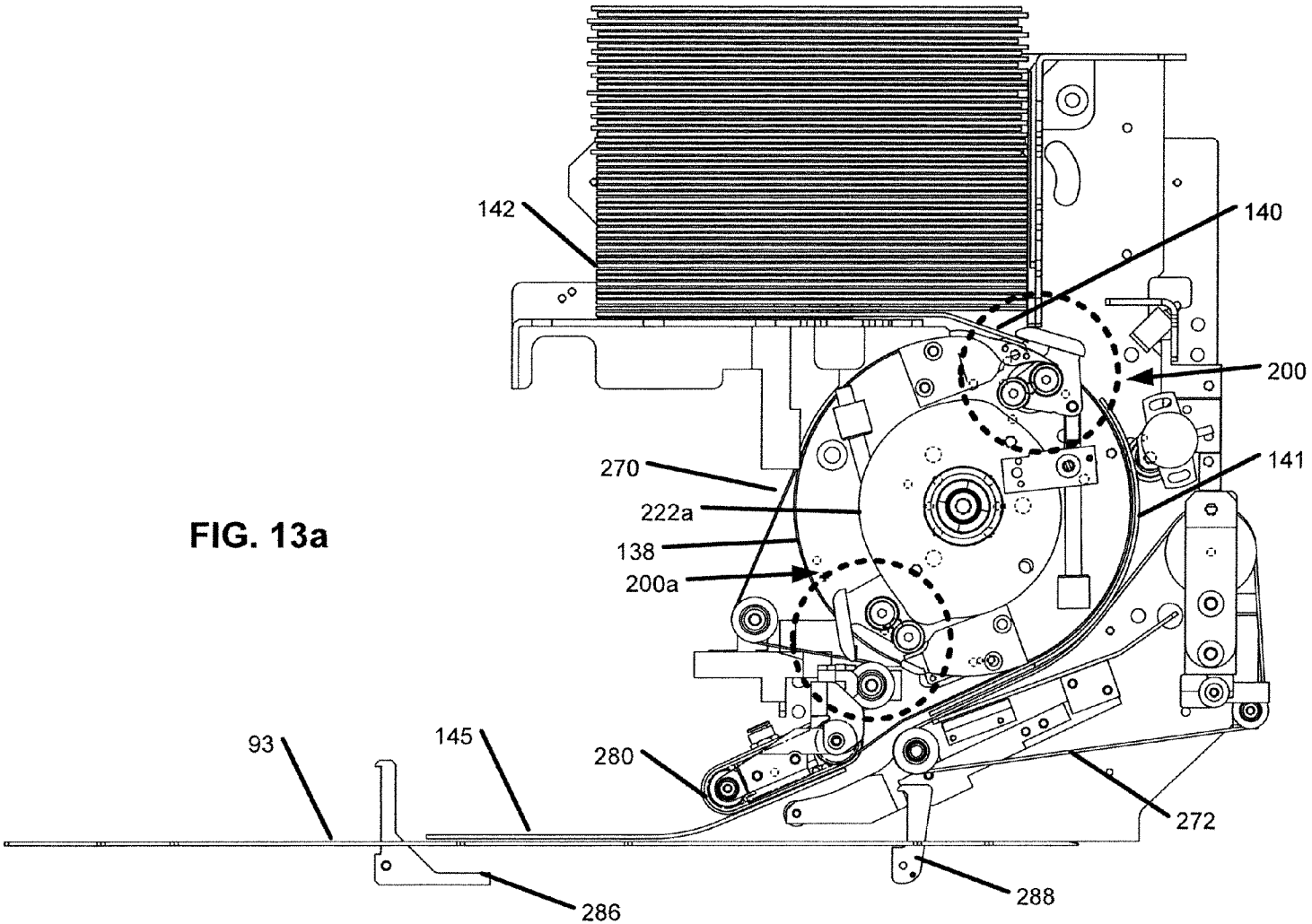
FIG. 13*a* is an exemplary illustration of the left side drum fitted with two gripper assemblies.

Turning now to FIG. 13*a* to illustrate an alternative solution to the gripper assembly configuration. This configuration utilizes two or more gripper assemblies 200, 200*a* on the left 138 drum and on the right (136, FIG. 10) drum to place inserts on the collation track 93. FIG. 13*a* is a view of the left side of the RIF. Using additional gripper assemblies 200, 200*a* enable the RIF to process three or more inserts at the same time. Synchronization with the collation track 93 is maintained by matching the drum 136, 138 circumferences with the pitch between the pusher pins 286, 288. For the example using one gripper assembly 200, the pitch between pins 286 and 288 is 21 inches which is suitable for both flat and letter inserts. For the example using two gripper assemblies 200, 200*a* the pitch between pins 286 and 288 is 10.5 inches which is suitable for letter inserts. As shown in FIG. 13*a*, gripper assembly 200 is extracting insert 140 from the stack of inserts 142. Insert 141 is held on the drum by the belts 270 and 272 after being released from the gripper assembly 200*a* by the action of the gripper assembly 200*a* on the opening cam 222*a*. Insert 145 is synchronously placed on the collation track 93 the correct distance in front of the pusher pin 288. Synchronization is maintained during placement on the collation track 93 by the vacuum belt 280 which insures no slippage as the insert 145 is released from the belts 270 and 272. Those skilled in the art can tradeoff drum diameter, rotational velocity, insert size and pusher pin spacing and velocity to implement other configurations of gripper assemblies.

Figure 14:
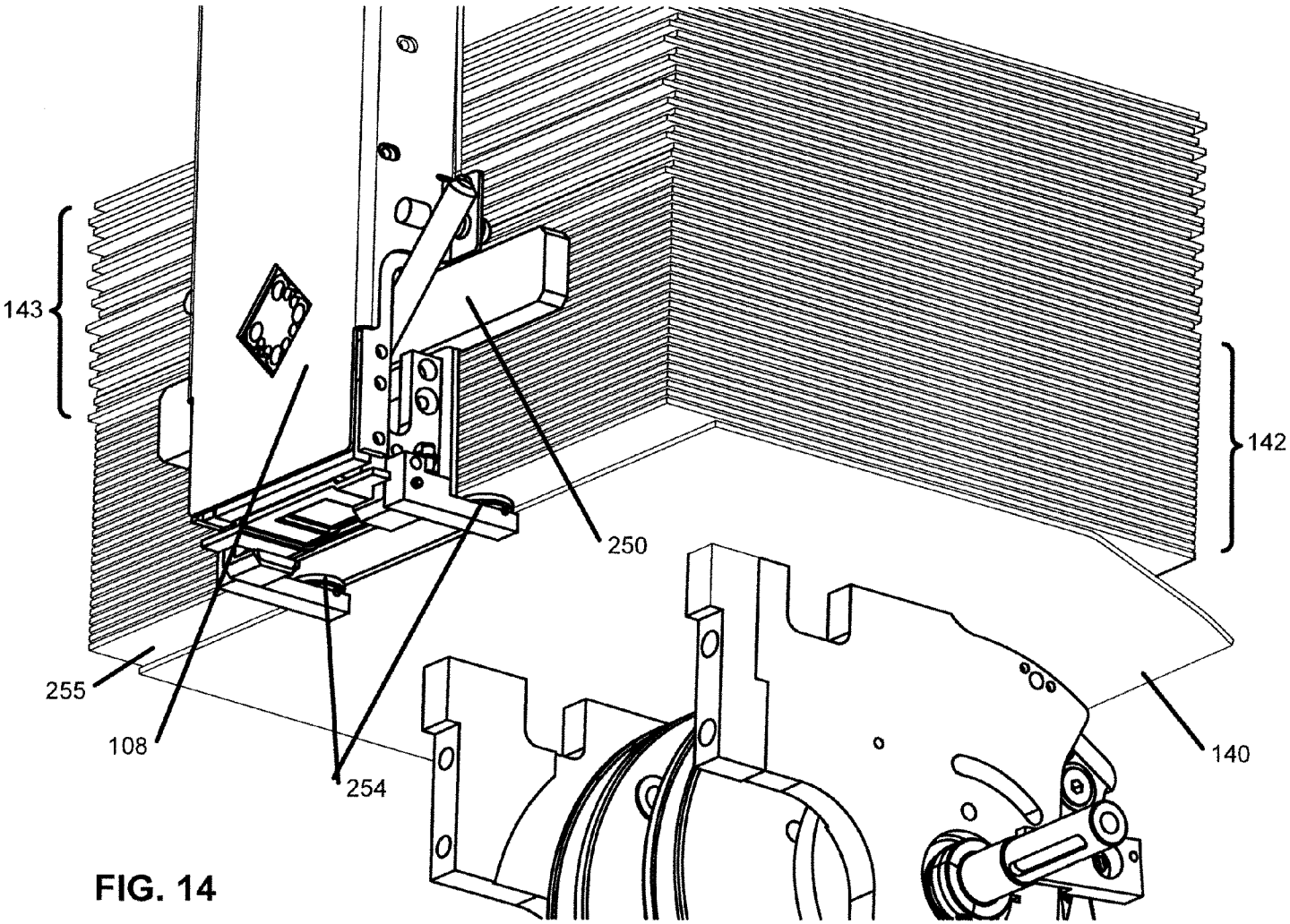
FIG. 14 is an exemplary illustration of the vacuum hold-back and stack assist tamper.
Figure 15:
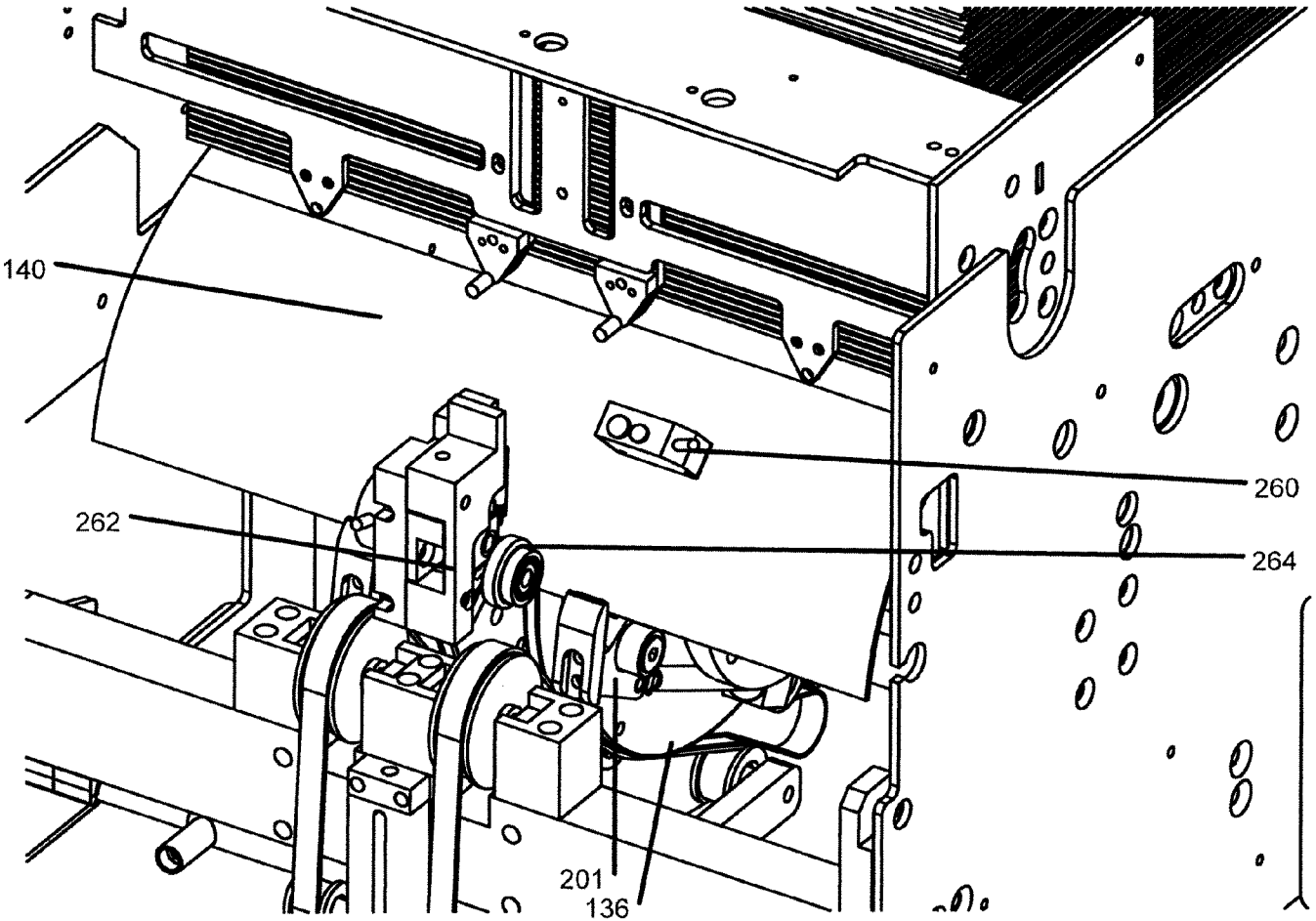
FIG. 15 is an exemplary illustration of the insert meeting the miss photocell and doubles detector.

Stack assist and vacuum holdback are used in the extraction of the bottom insert 140 from the stack 142. The inserts should be justified forward to ensure that the gripper fingers will close on the bottom insert. In addition, a vacuum hold back is used to prevent double feeds. FIG. 14 illustrates both features in a bottom back view of the RIF. The stack assist is designed to take an irregular stack 143 and lead edge register the inserts in the stack 142. This is accomplished by the stack assist assembly 108 which contains a pneumatic actuator that drives a tamper bar 250 to tamp the stack at a given frequency. The frequency is determined during setup when the thickness of the insert is measured by the thickness detector 262 (FIG. 15). To determine the frequency at which the tamper is actuated, the height of the stack assist tamp is divided by the calculated enclosure thickness to get the number of enclosures in front of the tamper. Next, this value is divided by the number of times a single enclosure needs to be tamped for correct lead edge registration in the hopper (software configurable parameter) to get the number of enclosure pulls per actuation. Over tamping can damage the inserts and under tamping will not result in front edge registration. Both situations will result in additional miss-feeds. After the bottom insert 140 has been pulled from the stack a sufficient amount to allow the holdback vacuum cups 254 to contact the next insert 255, the vacuum is turned on and remains turned on for most of the rest of the feed cycle. The holdback vacuum cups 254 will hold the next insert 255 in place in the stack, thus preventing forward motion during the extraction of the bottom insert 140 and material handling issues in the subsequent insert extraction. Those skilled in the art may select o-rings or sucker cups of various characteristics for the hold back vacuum cups 2254 depending on the type of inserts that are encountered.

The next steps in the feed cycle are illustrated in FIG. 15. The drum 136 rotates the gripper assembly 201 pulling the bottom insert 140 out of the stack past the miss-feed photocell 260. If the photocell 260 is not blocked by the bottom insert 140 within the expected time, a miss-feed is declared. The equipment may be stopped for operator corrective action or other actions may occur such as, but not limited to, continuing processing and diverting the faulty mailpiece for later corrective action. Double feeds are detected by a doubles detector sensor 262. The thickness is measured by detecting the amount of rotation sensed by the thickness detector sensor. The deflection of the follower wheel 264 from its home position of riding on the drum 136 is proportional to the thickness of the insert(s). The measured thickness is compared to the value measured in setup when it is known that a single insert is in the feeder path. If a threshold for the amount of rotation is achieved a doubles detect condition is declared. Those skilled in the art will appreciate that other thickness measurement devices can be selected. The equipment may be stopped for operator corrective action or other action may occur such as, but not limited to, continuing processing and diverting the faulty mailpiece for later corrective action.

Figure 16:
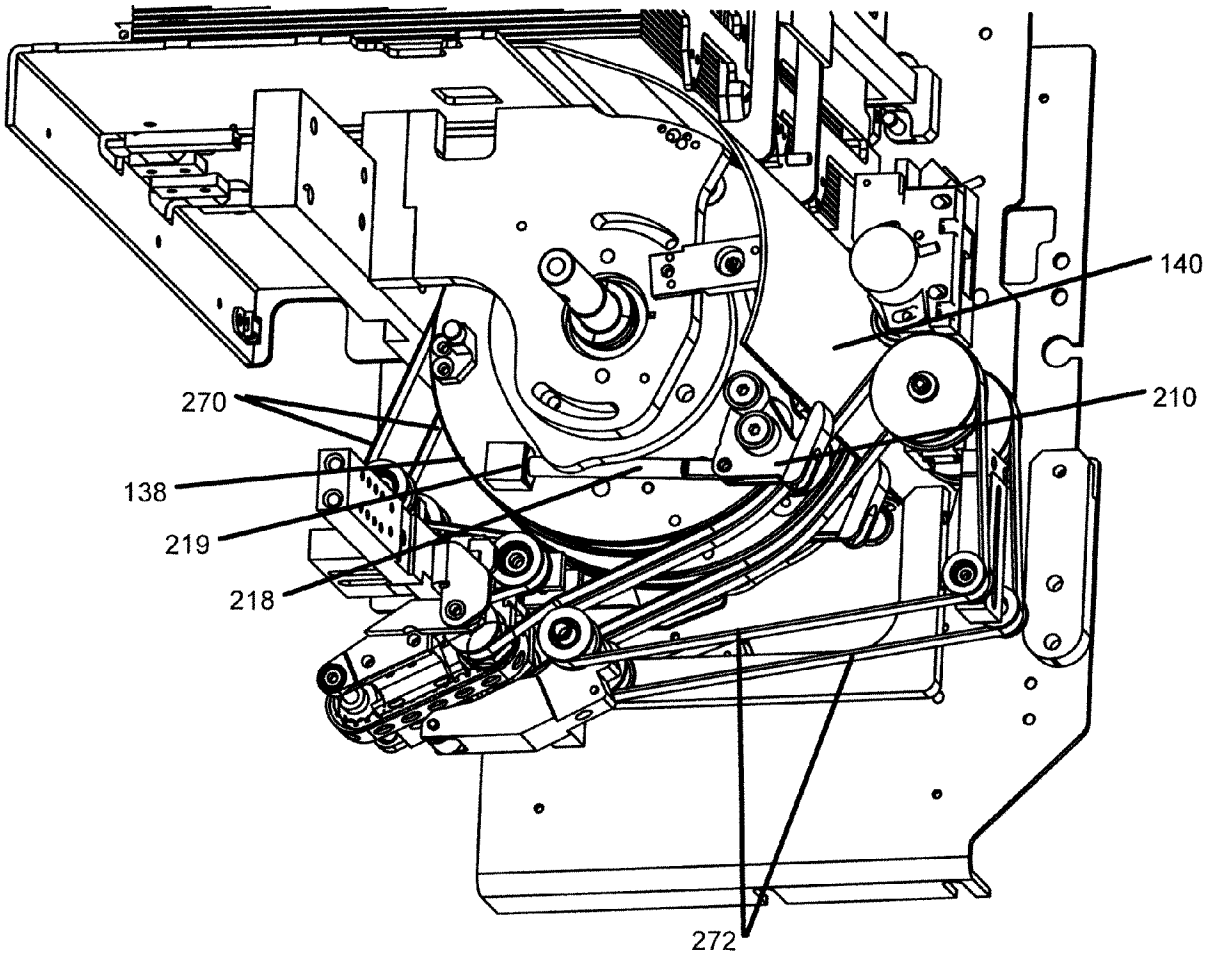
FIG. 16 is an exemplary illustration of guide belts that delivery the insert to the collation track.

FIG. 16 is a bottom view showing the handoff of the bottom insert 140 to the belt drive system. The drum belt pair 270 is wrapped around the surfaces of drums 136, 138 and form the upper pair of belts that will transport the bottom insert 140 once the gripper 210 opens. The bottom belt pair 272 forms the opposing belts that keep the bottom insert 140 trapped, driven and prevents skew. The surfaces of drums 138, 136, drum belt pair 270, and the bottom belt pair, are all driven at the same speed. This speed is synchronized to the collating track 93 in the inserter 92 by an encoder on the collating track 93 and the servo controller (not shown). The actuator bar 218 attachment and pivot point 219, as referenced in FIGS. 11, 12 and 13, are shown in FIG. 16.

Figure 17:
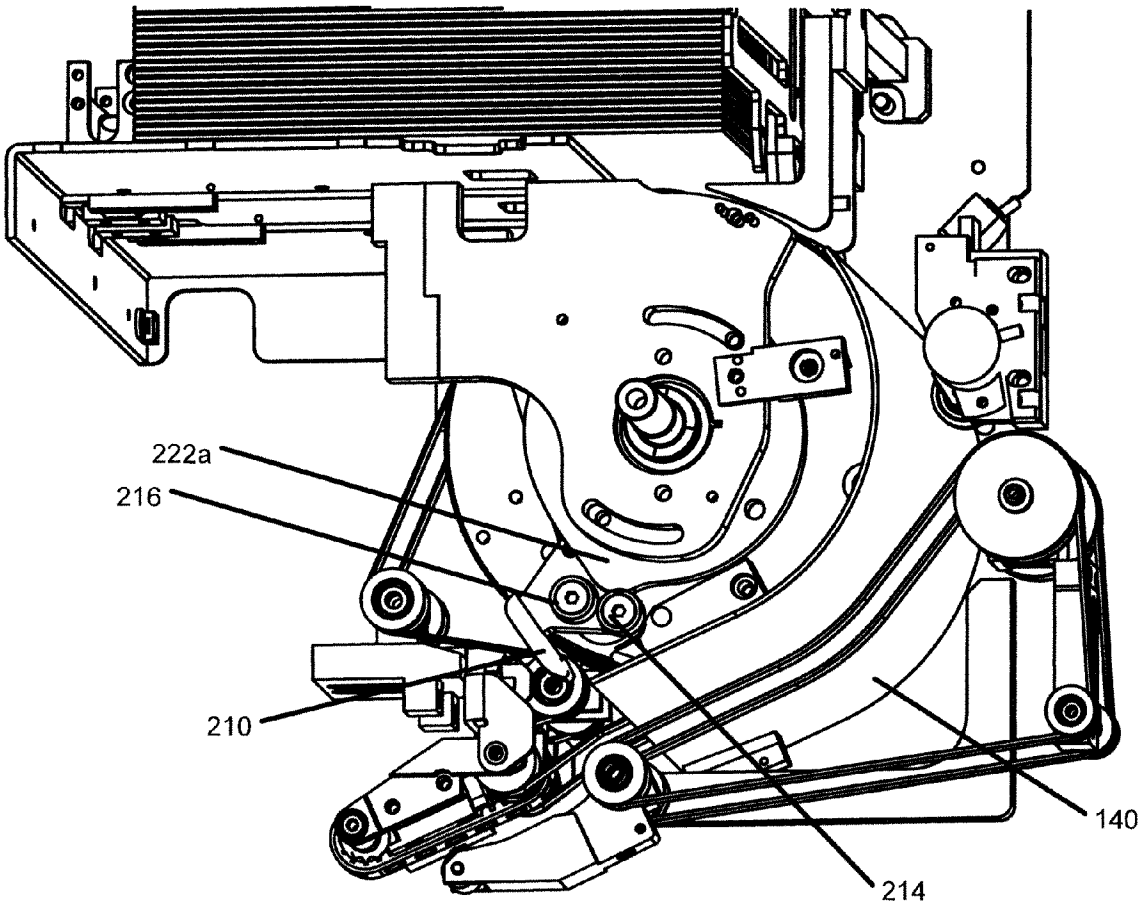
FIG. 17 is an exemplary illustration of the grippers releasing the insert.

FIG. 17 illustrates the gripper 210 returning to the open position by the action of the opening cam 222*a* and the left 214 and right 216 cam followers. Note that the right and left reference is reversed in this inverted view of the gripper 210. The bottom insert 140 is now secured and driven solely by the belt pairs referenced above.

Figure 18:
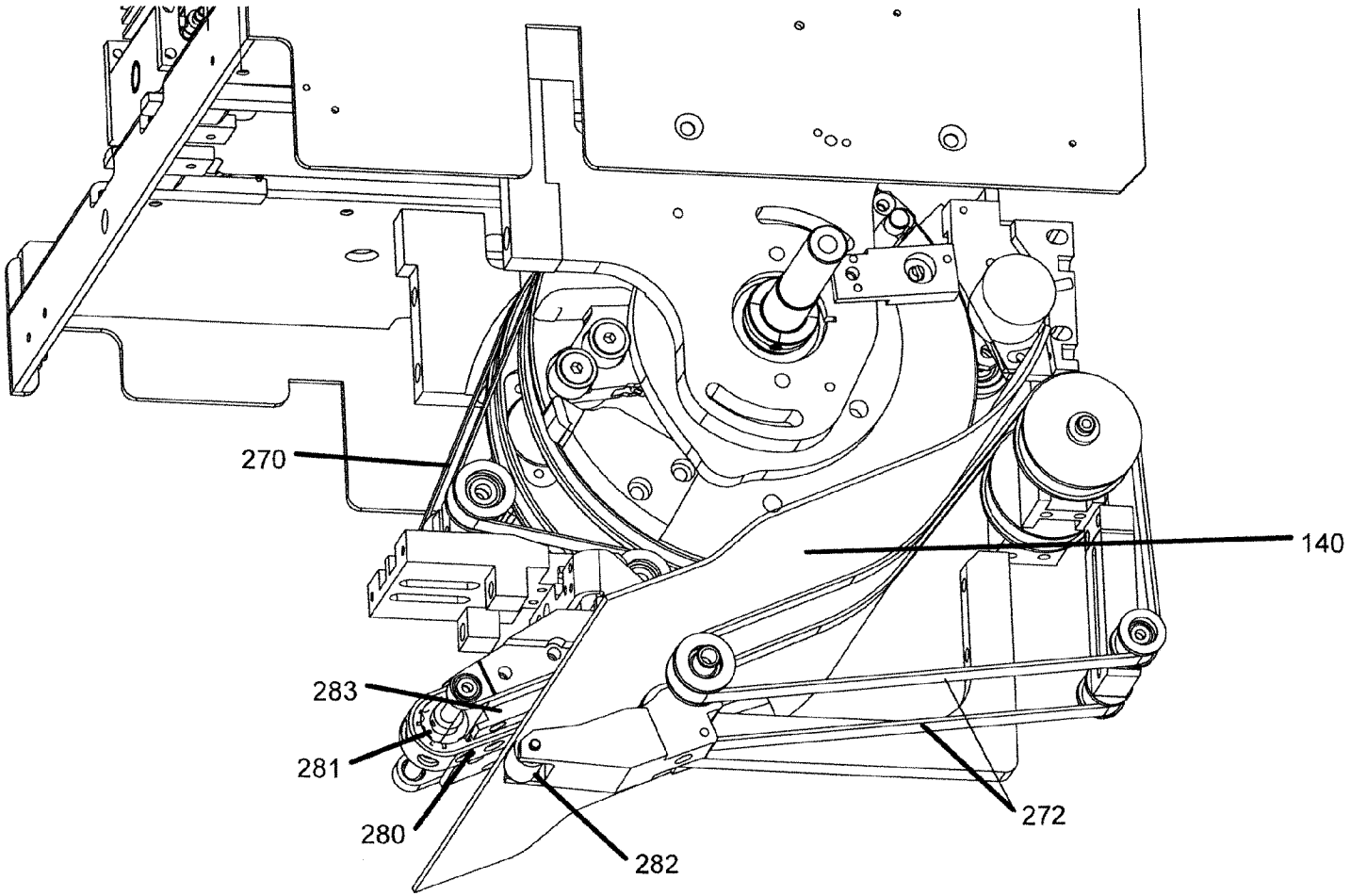
FIG. 18 is an exemplary illustration of the insert engaging the vacuum belt prior to release onto the collation track.

Attention is now directed to FIG. 18 for an illustration of the transition of the bottom insert 140 from the belt pairs 270, 272 to the vacuum belt 280. The vacuum belt 280 also is driven at the same speed as the previously referenced belts and drums. To ensure that the bottom insert 140 is picked up by the vacuum belt 280 a spring loaded follower 282 initially holds the bottom insert 140 against the vacuum belt 280. The location of the follower 282 versus the vacuum belt pulley 281 is used for the successful delivery of the bottom insert 140 to the collating track 93 FIG. 20. When the bottom insert 140 leading edge reaches the end of the vacuum chamber 283, the bottom insert 140 starts to bend toward the collating track 93. This motion helps remove air that otherwise maybe trapped beneath the insert. The trapped air can contribute to a poor quality of the stack of inserts on the collation track. The vacuum belt 280 ensures that the bottom insert 140 is driven onto the collating track 93 until the trailing edge of the insert 140 passes beyond the vacuum chamber 283 and is released. Positive control of the bottom insert 140 up to the trailing edge also reduces slippage that would result in loss of synchronization between the placement location of the bottom insert and the collating track pusher pins 288, 286 (FIG. 20).

Figure 19:
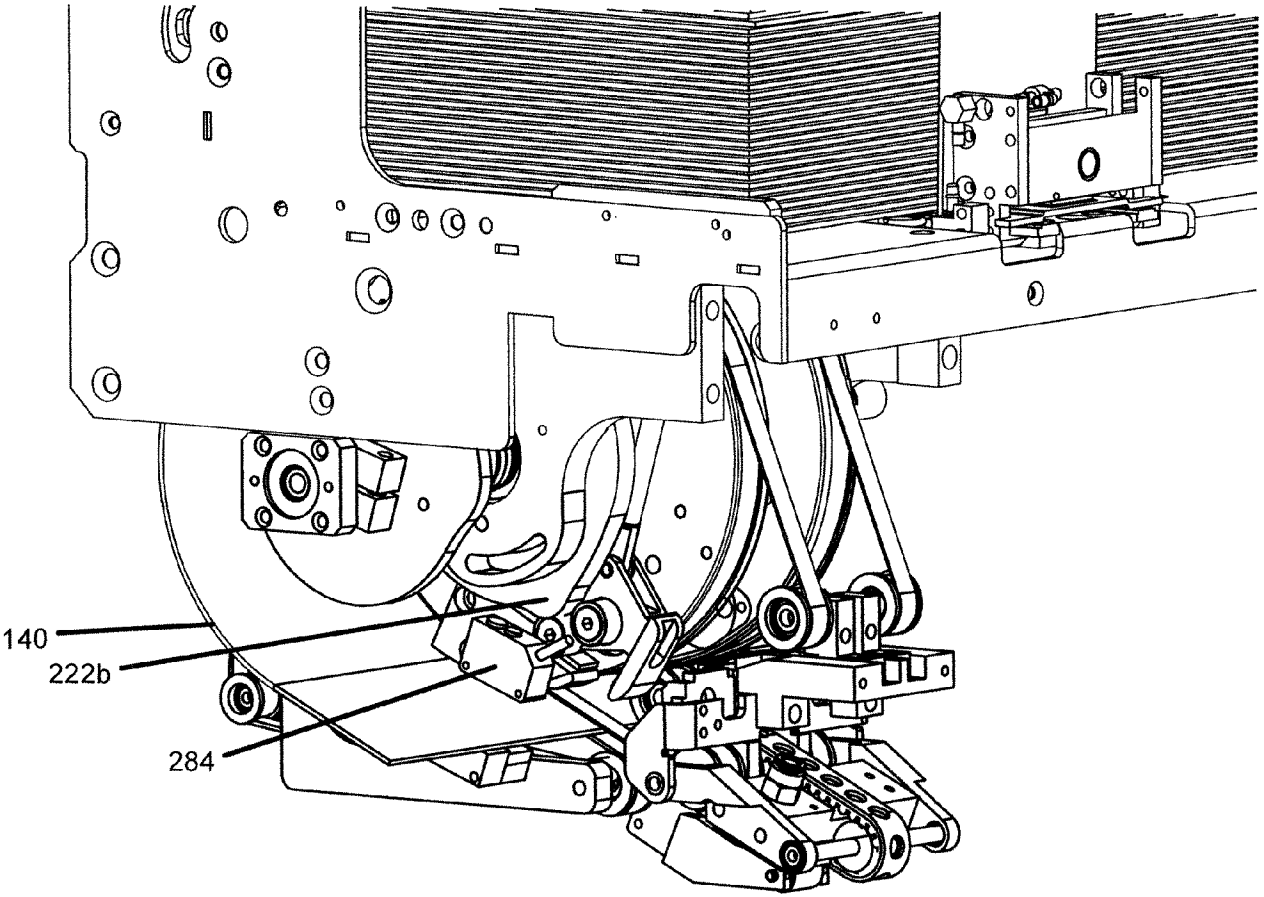
FIG. 19 is an exemplary illustration of the output photocell.

FIG. 19 identifies the location of the output photocell 284 located on the bottom output section in the vicinity of the gripper opening cam lobe 222*b*. If a miss-feed is detected due to the photocell not being blocked at the expected time, the equipment may be stopped for operator corrective action or other action(s) may occur such as, but not limited to, continuing processing and diverting the faulty mailpiece for later corrective action. The output photocell 284 is used to measure insert length during setup. The length is equal to the synchronous speed of the belts and drums times the time the photocell is blocked.

Figure 20:
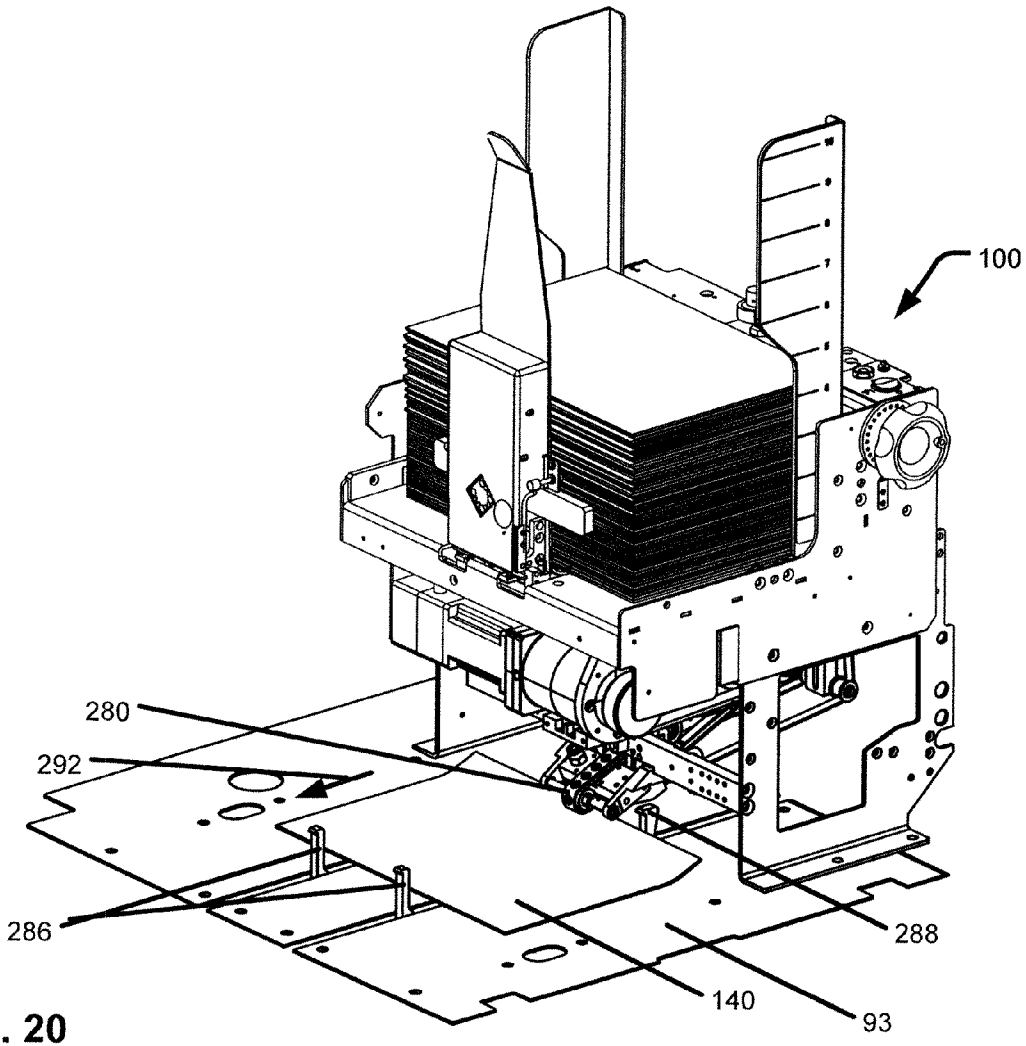
FIG. 20 is an exemplary illustration of the insert being fed to the collation track.

FIG. 20 is an isometric view from the back of the RIF 100 with the RIF attached to the collating track 93 of the inserter 92. The bottom insert 140 is placed between the leading pusher pins 286 and the trailing pusher pins 288 by the vacuum belt 280. The bottom insert 140 that is shown is at the maximum length since it fits between the pusher pins 286, 288. The pusher pins are moving from right to left, as shown by the directional arrow 292. The trailing pusher pins 288 engage the bottom insert 140 and move it down the collating track 93 to the next insert feeder or to the envelope insertion section or to the wrapping section.

Figure 21:
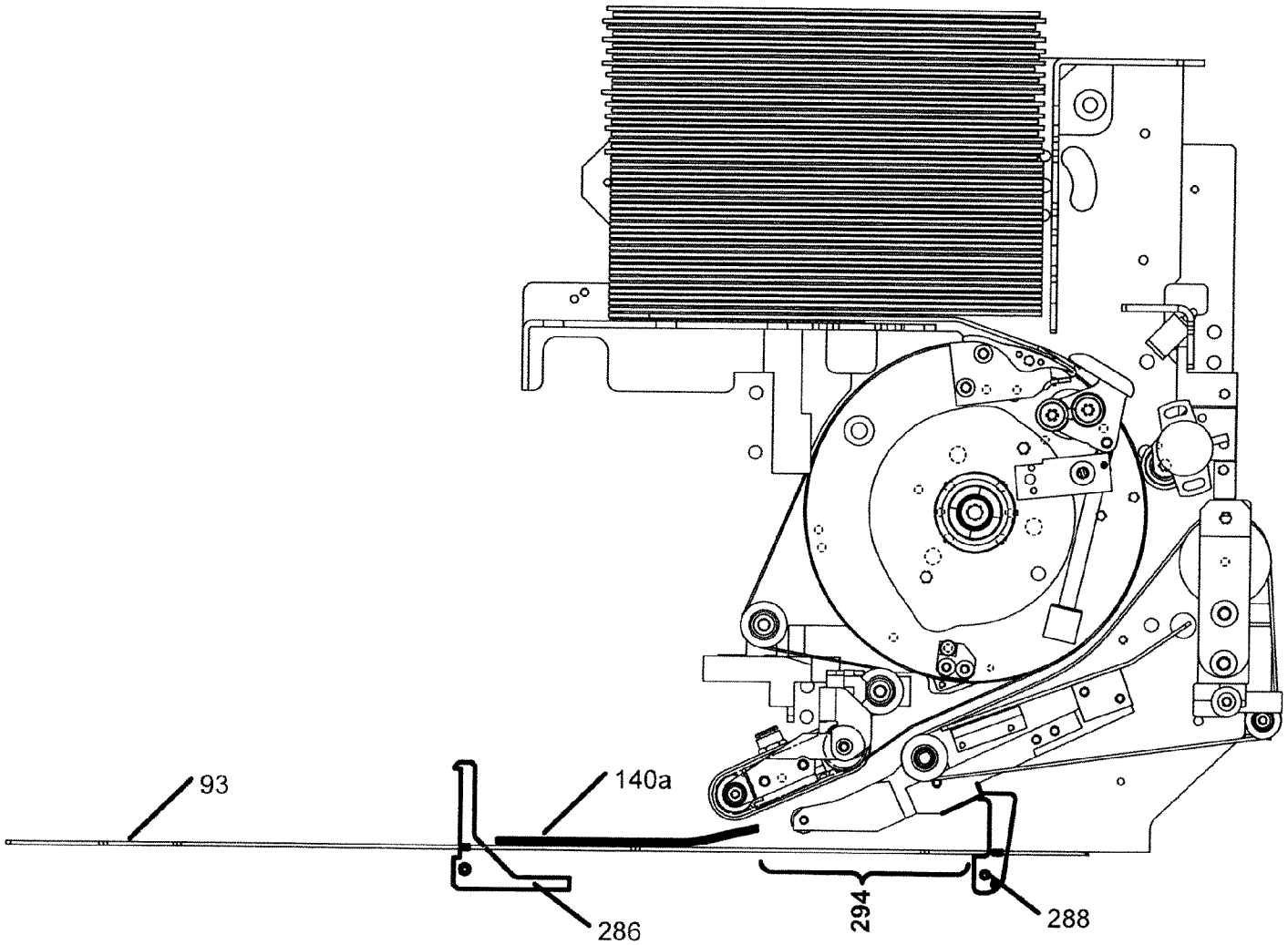
FIG. 21 is an exemplary illustration of an insert that is not correctly synchronized to the collation track guide pins.
Figure 22:
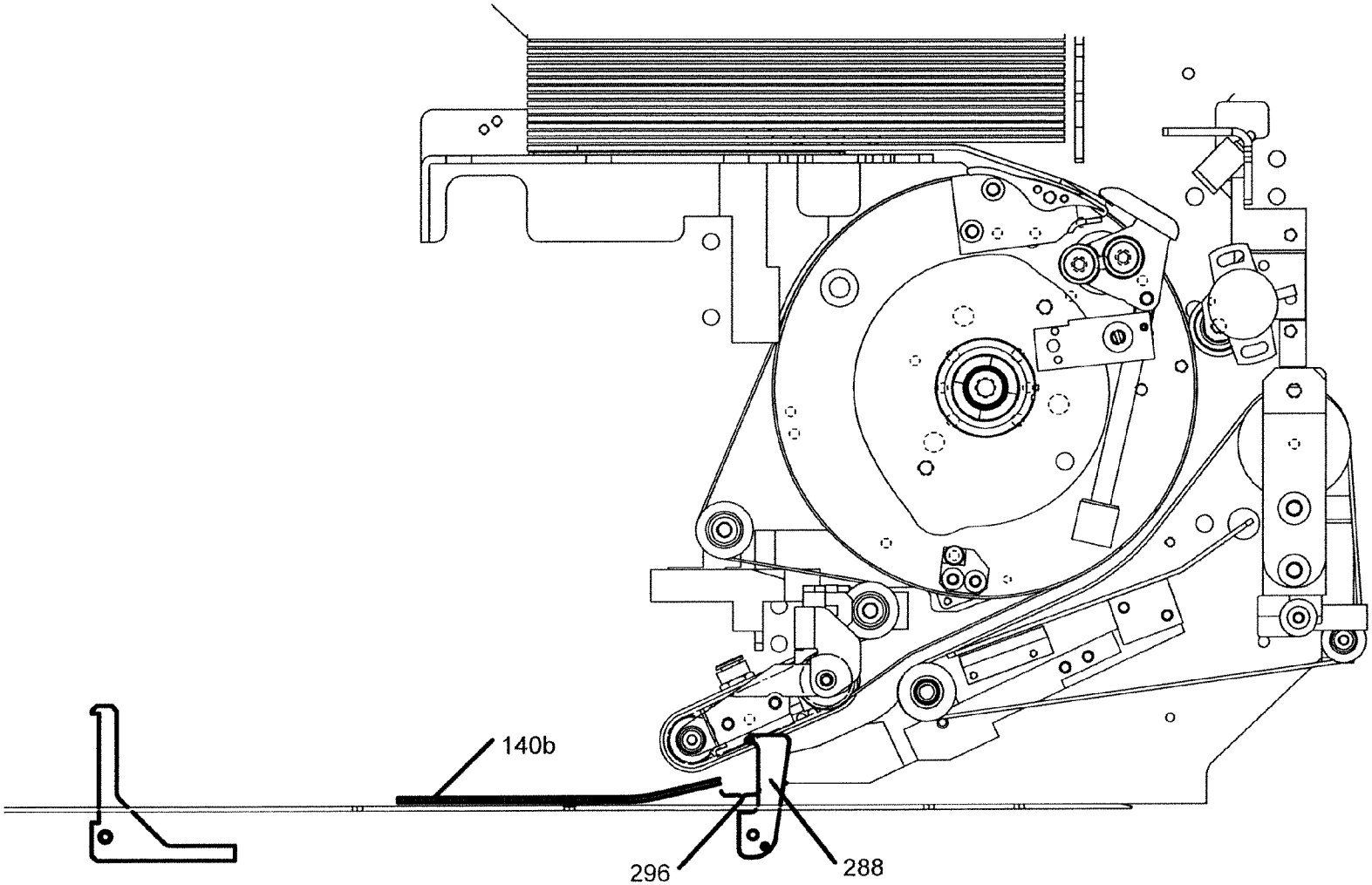
FIG. 22 is an exemplary illustration of an insert that is correctly synchronized to the collation track guide pins.

FIGS. 21 and 22 represent the two positions that are encountered during the setup mode for a new job. In setup mode, the control system 90 sets up each RIF 100 to deliver an insert 140*a* just behind the leading pusher pins 286. This location will accommodate the largest size insert. However, even though all inserts could be fed in this manner it is unlikely that all of the shorter inserts would end up registered against the trailing pusher pin 288 as it moves the stack of inserts down the collating track 93. The insert length is measured when fed as described above with output photocell 284. Using the known spacing between the leading 286 and trailing 288 pusher pins and the insert length, the distance 294 from the insert trailing edge and the trailing pusher pin 288 can be calculated. This distance 294 can be translated into time or encoder pulses to be used to set up an offset to the feeder start time. At restart of the system, the controller 90 uses the offset value 294 to readjust each RIF's rotational position such that the feeder's rotational position relative to the collating track position is optimal for feeding the insert size measured. After the readjustment, each RIF 100 will feed the insert 140*b* to be a ½ inch 296 from the trailing pusher pin 288. As appreciated by those skilled in the art, other system configurations can be used to select different spacing for the gap 296.

Figure 23:
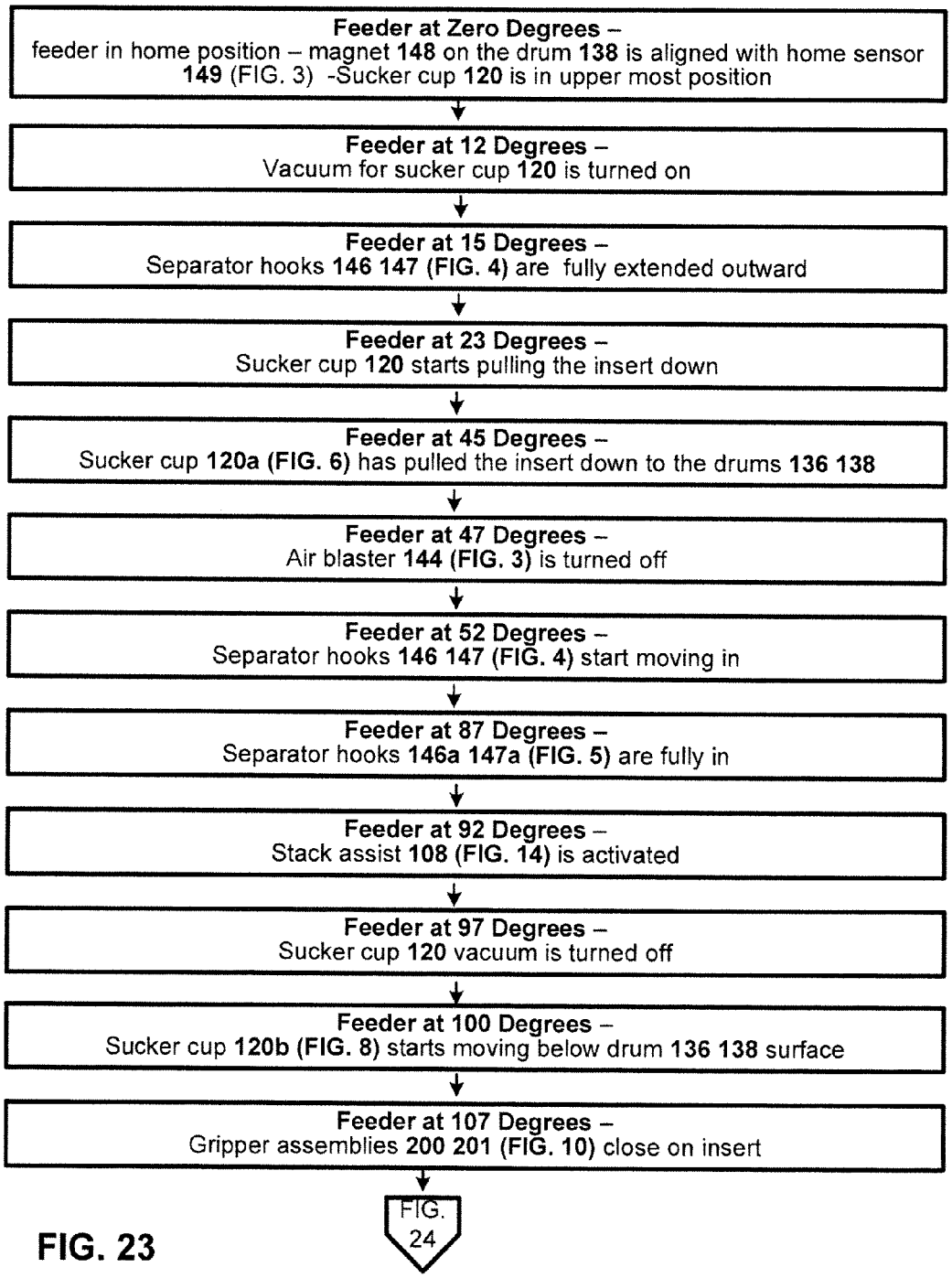
FIG. 23 is an exemplary rotary feeder stage diagram starting at the zero degree home position thru 107 degrees.
Figure 24:
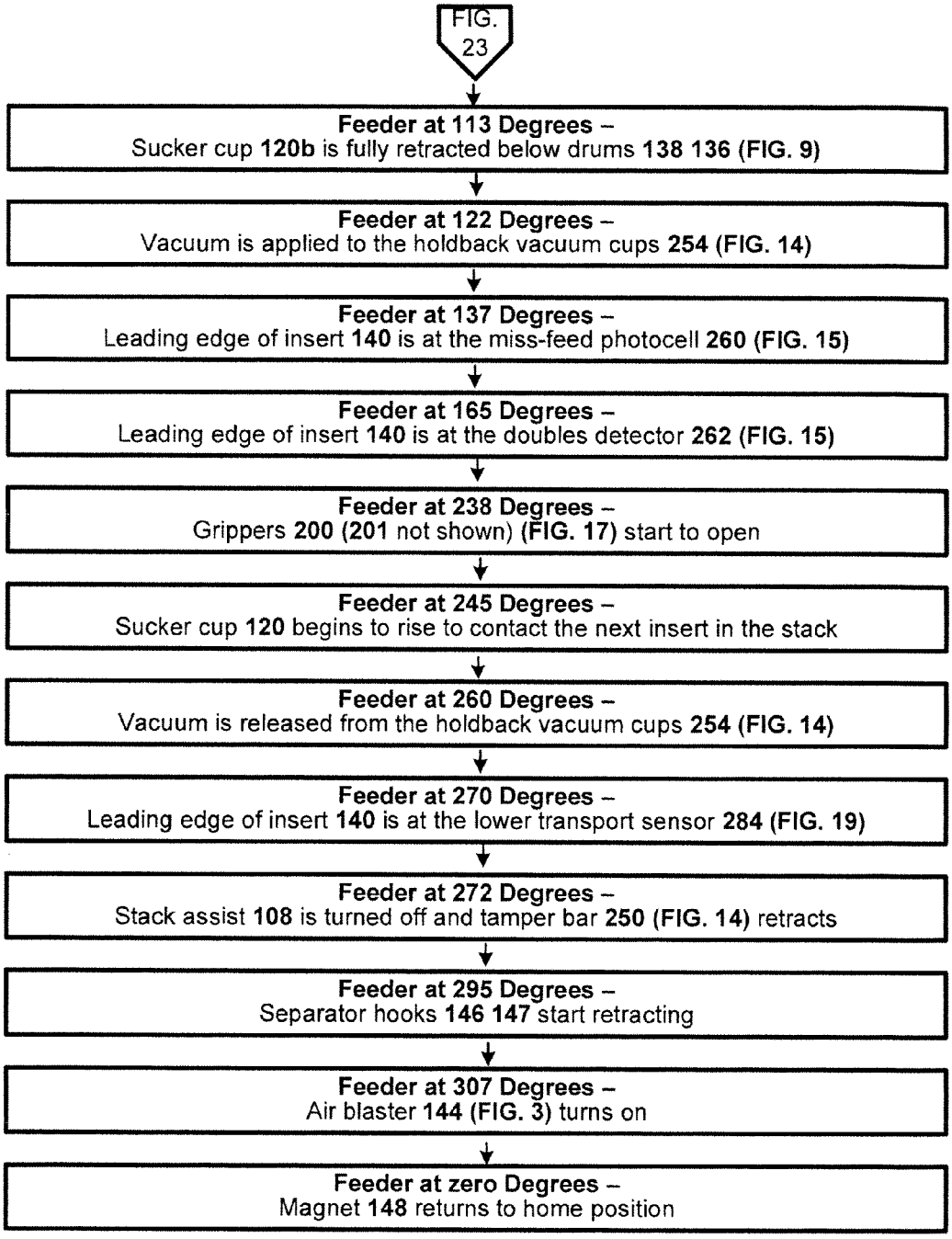
FIG. 24 is an exemplary rotary feeder stage diagram continuing at the 113 degree position and continuing to the home position.

FIGS. 23 and 24 define the actions performed at various stages in a feed cycle for the RIF 100. These actions are defined relative to a number of degrees of rotation from the "home" position. The degree values and the actions that occur are representative of the preferred implementation. However, those skilled in the art may chose different implementations, without significantly altering the effectiveness of the RIF disclosed herein.

As shown by the above discussion, functions relating pertain to the operation of a RIF 100 are implemented in the hardware and controlled by one or more computers operating as the control computer 90. The control computer 90 may be connected to a data center processor/server 91 along with other inserter/wrapper control computers for job set up and for job reporting. Although special purpose devices may be used, such devices also may be implemented using one or more hardware platforms intended to represent a general class of data processing device commonly used to run "server" programming so as to implement the functions discussed above, albeit with an appropriate network connection for data communication.

As known in the data processing and communications arts, a general-purpose computer typically comprises a central processor or other processing device, an internal communication bus, various types of memory or storage media (RAM, ROM, EEPROM, cache memory, disk drives etc.) for code and data storage, and one or more network interface cards or ports for communication purposes. The software functionalities involve programming, including executable code as well as associated stored data. The software code is executable by the general-purpose computer that functions as the control processor 170 and/or the associated terminal device. In operation, the code is stored within the general-purpose computer platform. At other times, however, the software may be stored at other locations and/or transported for loading into the appropriate general-purpose computer system. Execution of such code by a processor of the computer platform enables the platform to implement the methodology for tracking of mail items through a postal authority network with reference to a specific mail target, in essentially the manner performed in the implementations discussed and illustrated herein.

Figure 25:
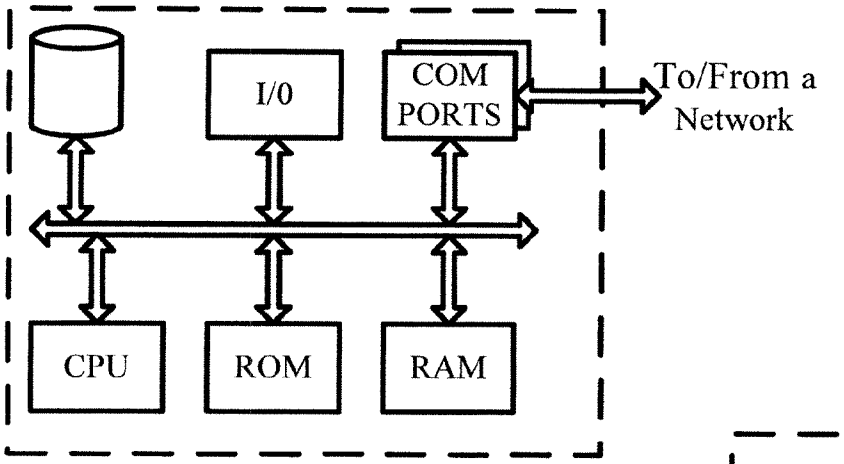
FIG. 25 illustrates a network or host computer platform, as may typically be used to implement a server.
Figure 26:
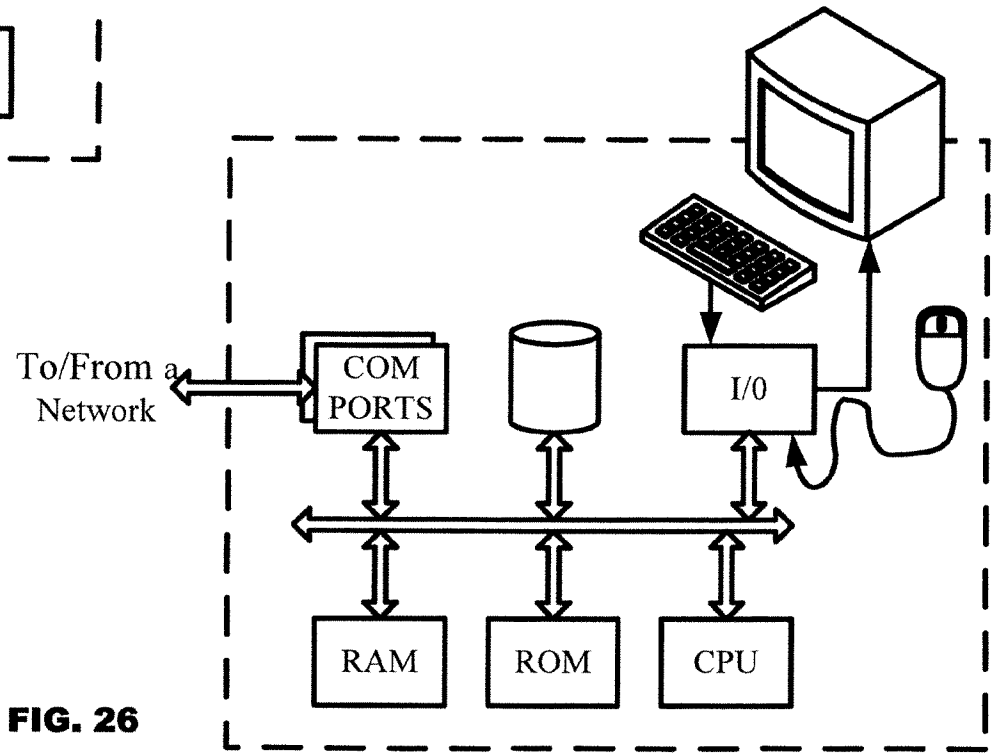
FIG. 26 depicts a computer with user interface elements, as may be used to implement a personal computer or other type of work station/controller or terminal device.

FIGS. 25 and 26 provide functional block diagram illustrations of general purpose computer hardware platforms. FIG. 25 illustrates a network or host computer platform, as may typically be used to implement a server. FIG. 25 depicts a computer with user interface elements, as may be used to implement a personal computer or other type of work station or terminal device, although the computer of FIG. 25 may also act as a server if appropriately programmed. It is believed that those skilled in the art are familiar with the structure, programming and general operation of such computer equipment and, as a result, the drawings should be self-explanatory.

For example, control computer 90 may be a PC based implementation of a central control processing system like that of FIG. 25, or may be implemented on a platform configured as a central or host computer or server like that of FIG. 26. Such a system typically contains a central processing unit (CPU), memories and an interconnect bus. The CPU may contain a single microprocessor (e.g. a Pentium microprocessor), or it may contain a plurality of microprocessors for configuring the CPU as a multi-processor system. The memories include a main memory, such as a dynamic random access memory (DRAM) and cache, as well as a read only memory, such as a PROM, an EPROM, a FLASH-EPROM or the like. The system memories also include one or more mass storage devices such as various disk drives, tape drives, etc.

In operation, the main memory stores at least portions of instructions for execution by the CPU and data for processing in accord with the executed instructions, for example, as uploaded from mass storage. The mass storage may include one or more magnetic disk or tape drives or optical disk drives, for storing data and instructions for use by CPU. For example, at least one mass storage system in the form of a disk drive or tape drive, stores the operating system and various application software. The mass storage within the computer system may also include one or more drives for various portable media, such as a floppy disk, a compact disc read only memory (CD-ROM), or an integrated circuit non-volatile memory adapter (i.e. PC-MCIA adapter) to input and output data and code to and from the computer system.

The system also includes one or more input/output interfaces for communications, shown by way of example as an interface for data communications with one or more other processing systems. Although not shown, one or more such interfaces may enable communications via a network, e.g., to enable sending and receiving instructions electronically. The physical communication links may be optical, wired, or wireless.

The computer system may further include appropriate input/output ports for interconnection with a display and a keyboard serving as the respective user interface for the processor/controller. For example, a printer control computer in a document factory may include a graphics subsystem to drive the output display. The output display, for example, may include a cathode ray tube (CRT) display, or a liquid crystal display (LCD) or other type of display device. The input control devices for such an implementation of the system would include the keyboard for inputting alphanumeric and other key information. The input control devices for the system may further include a cursor control device (not shown), such as a mouse, a touchpad, a trackball, stylus, or cursor direction keys. The links of the peripherals to the system may be wired connections or use wireless communications.

The computer system runs a variety of applications programs and stores data, enabling one or more interactions via the user interface provided, and/or over a network to implement the desired processing, in this case, including those for tracking of mail items through a postal authority network with reference to a specific mail target, as discussed above.

The components contained in the computer system are those typically found in general purpose computer systems. Although summarized in the discussion above mainly as a PC type implementation, those skilled in the art will recognize that the class of applicable computer systems also encompasses systems used as host computers, servers, workstations, network terminals, and the like. In fact, these components are intended to represent a broad category of such computer components that are well known in the art. The present examples are not limited to any one network or computing infrastructure model—i.e., peer-to-peer, client server, distributed, etc.

Hence aspects of the techniques discussed herein encompass hardware and programmed equipment for controlling the relevant document processing as well as software programming, for controlling the relevant functions. A software or program product, which may be referred to as a "program article of manufacture" may take the form of code or executable instructions for causing a computer or other programmable equipment to perform the relevant data processing steps, where the code or instructions are carried by or otherwise embodied in a medium readable by a computer or other machine. Instructions or code for implementing such operations may be in the form of computer instruction in any form (e.g., source code, object code, interpreted code, etc.) stored in or carried by any readable medium.

Such a program article or product therefore takes the form of executable code and/or associated data that is carried on or embodied in a type of machine readable medium. "Storage" type media include any or all of the memory of the computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Such communications, for example, may enable loading of the relevant software from one computer or processor into another, for example, from a management server or host computer into the image processor and comparator. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible "storage" media, terms such as computer or machine "readable medium" refer to any medium that participates in providing instructions to a processor for execution.

Hence, a machine readable medium may take many forms, including but not limited to, a tangible storage medium, a carrier wave medium or physical transmission medium. Non-volatile storage media include, for example, optical or magnetic disks, such as any of the storage devices in any computer(s) or the like. Volatile storage media include dynamic memory, such as main memory of such a computer platform. Tangible transmission media include coaxial cables; copper wire and fiber optics, including the wires that comprise a bus within a computer system. Carrier-wave transmission media can take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A rotary insert feeder for processing a plurality of irregularly stacked inserts, the rotary insert feeder comprising:

a stacker for containing the plurality of irregularly stacked inserts, the stacker comprising:

a pair of vertical side supports;

a bottom plate disposed between the vertical side supports;

an insert thickness detector;

a back support stack assist assembly, the back support stack assist assembly including:

a tamper bar, in operable connection with a processor, configured to tamp the stack at a predetermined frequency such that a leading edge of the bottommost insert is positioned for removal from the stacker below the bottom plate;

a holdback vacuum for contacting the second bottommost insert during removal of the bottommost insert, such that the second bottommost insert is not removed at the same time as the bottommost insert, wherein the predetermined frequency is based on a thickness measurement obtained by the insert thickness detector.

2. The rotary insert feeder according to claim 1, wherein the hold back vacuum comprises a plurality of vacuum gripping devices positioned adjacent to a bottom surface of the back support stack assist assembly facing inward towards trailing edges of the stacked inserts.

3. The rotary insert feeder according to claim 1, wherein the tamper bar extends horizontally outward from the vertical back support stack assist assembly.

4. The rotary insert feeder according to claim 1, wherein a pneumatic actuator drives the tamper bar to tamp the stack at the predetermined frequency.

5. The rotary insert feeder according to claim 1, wherein the holdback vacuum comprises vacuum cups or rings for holding the second bottommost insert in place in the stack to prevent its forward motion during the removal of the bottommost insert.

6. The rotary insert feeder according to claim 1, further comprising: a miss-feed detector positioned such that a miss-feed signal is generated if the bottommost insert is not detected within a pre-determined time period.

7. The rotary insert feeder according to claim 1, further comprising: a double-feed detector, wherein a double feed condition is detected when a measured thickness of the bottommost insert exceeds an initial thickness of the bottommost insert acquired during setup.

8. The rotary insert feeder according to claim 1, frequency at which the tamper bar is actuated is determined by:

dividing the height of the stack assist tamp is divided by a calculated insert thickness to obtain a number of inserts positioned in front of the tamper bar; and the obtained number of inserts is divided by the number of times a single insert is required to be tamped for correct lead edge registration to obtain the number of insert pulls per actuation.

9. A method for processing a plurality of irregularly stacked inserts on a rotary insert feeder, the method comprising steps of:

providing the plurality of irregularly stacked inserts in a stacker, the stacker including:

a pair of vertical side supports;

a bottom plate disposed between the vertical side supports;

an insert thickness detector;

a back support stack assist assembly including a tamper bar, a processor configured to control the tamper bar for:

tamping the irregular stack of inserts at a predetermined frequency such that a leading edge of the bottommost insert is positioned for removal from the stacker below the bottom plate, the predetermined frequency based on a thickness measurement obtained by the insert thickness detector;

removing the bottommost insert; and during the removing step, contacting the second bottommost insert by way of a holdback vacuum, such that the second bottommost insert is not removed at the same time as the bottommost insert.

10. The method according to 9, wherein the contacting step includes preventing forward advancement of the second bottommost insert until the bottommost insert is removed from the vertical stack.

11. The method according to 9, further comprising the step of: generating a miss-feed signal if the bottommost insert is not detected within a pre-determined time period.

12. The method according to 9, further comprising the step of: detecting a double feed when a measured thickness of the bottommost insert exceeds an initial thickness of the bottommost insert acquired during setup.

13. The method according to 9, frequency at which the tamper bar is actuated is determined by:

dividing the height of the stack assist tamp is divided by a calculated insert thickness to obtain a number of inserts positioned in front of the tamper bar; and the obtained number of inserts is divided by the number of times a single insert is required to be tamped for correct lead edge registration to obtain the number of insert pulls per actuation.

* * * * *